US005531430A

United States Patent [19]

Tokunoh

[11] Patent Number: 5,531,430

[45] Date of Patent: Jul. 2, 1996

[54] COPYING MACHINE WITH SORTER UNIT

[75] Inventor: Yoshiaki Tokunoh, Yokohama, Japan

[73] Assignee: Kabushiki Kaisha Toshiba, Kawasaki, Japan

[21] Appl. No.: 277,264

[22] Filed: Jul. 21, 1994

[30] Foreign Application Priority Data

Jul. 27, 1993 [JP] Japan ..... 5-184864

[51] Int. Cl.[6] ..... B65H 39/02; B65H 39/10

[52] U.S. Cl. ..... 270/58.02; 355/322; 271/290; 270/58.19; 270/58.28

[58] Field of Search ..... 270/53, 58; 271/290, 271/292, 294, 288, 289; 355/322, 324

[56] References Cited

U.S. PATENT DOCUMENTS

| | | | |
|---|---|---|---|
| 3,395,913 | 8/1968 | Del Vecchio et al. | 270/58 X |
| 3,709,480 | 1/1973 | Schulze et al. | 270/58 X |
| 5,013,027 | 5/1991 | Furukawa | 271/294 X |
| 5,177,546 | 1/1993 | Tsubo | 270/58 X |
| 5,248,136 | 9/1993 | Hamanaka | 270/58 |
| 5,269,503 | 12/1993 | Hiroi et al. | 270/53 |
| 5,342,034 | 8/1994 | Mandel et al. | 270/53 |

FOREIGN PATENT DOCUMENTS

| | | | |
|---|---|---|---|
| 62-222967 | 9/1987 | Japan | 270/58 |
| 3-264469 | 11/1991 | Japan | 271/288 |
| 5-307 | 1/1993 | Japan . | |

OTHER PUBLICATIONS

Xerox Disclosure Journal, Telescoping Sorter Bin Array, D. J. Stemmle, vol. 10 No. 5 Sep./Oct. 1985, p. 275.

*Primary Examiner*—John E. Ryznic
*Attorney, Agent, or Firm*—Foley & Lardner

[57] ABSTRACT

According to a copying machine with sorter of the present invention, discharged papers on which an image of an original is copied through a main body of the copying machine are sequentially contained in each paper tray of a first sorter, which is provided to be adjacent to the main body of the copying machine, and each paper tray of a second sorter, which is provided to be adjacent to the first sorter. At the time when all discharged papers are contained in each paper tray of each of the first and second sorters, the paper tray of the first sorter, which is provided between the second sorter and the main body of the copying machine, is moved up to a predetermined position, for example, a position where a position sensor is actuated.

9 Claims, 16 Drawing Sheets

COPYING MACHINE WITH SORTER UNIT

BACKGROUND OF THE INVENTION

1. Field of the Invention

The present invention relates to a copying machine with a sorter wherein an image on an object can be copied to a recording material and a lot of recorded materials are sorted and stored by the sorter.

2. Description of the Related Art

An image forming apparatus, e.g., an electrostatic copying machine forms an image of an object on paper for copying based on an image of the object read by a reading section. The image forming apparatus has a sorter for sorting paper on which the image is formed and storing paper therein.

The sorter includes a bin unit integrally having a plurality of paper trays (bins) for storing copied paper discharged from an image forming section of the image forming apparatus are sorted, a driving motor for relatively moving the bin unit up and down to a paper discharging section of the image forming section, and a paper transporting mechanism of transporting the discharged paper from the sorter provided at a position close to the image forming section to the sorter provided at a position away from the image forming section when two or more sorters are used at the same time.

The bin unit has a sorting section having 5 to 25 paper trays (bins) each can store 50 to 100 discharged paper and a non-sort tray which is provided at the uppermost portion of the sorting section and can store 100 to 250 discharged paper.

This type of the sorter has sorting functions such as a non-sort mode in which discharged papers discharged from the image forming section are contained in a stack, a sort mode in which the discharged papers are sorted in order of page of the original and contained, a group mode in which the discharged papers of the same page of the original are grouped together and contained, and a cascade mode in which when the number of discharged papers exceeds a predetermined value, the extra number of discharged papers is sequentially contained in a bin, which is not used at present.

More specifically, in the non-sort mode, a bin unit is moved down to the lowest position (home position) by the driving motor, and the discharged papers discharged from the image forming section are contained in a stack. In other words, the non-sort mode functions as a general discharging tray.

In the sort mode, the bin unit is moved up and down by the driving motor and the discharged paper having an image of the same document as the original discharged from the image forming section is contained one by one in the bin corresponding to the number of the coping papers, and the sequential discharged paper having an image of a next document is stacked one by one in order.

In the group mode, every time when the copy of the same document as the original is finished, the bin unit is moved by one bin, and the discharged papers having an image of the same document of the original are grouped together and contained in a stack.

In the above sorter, in a case that the sorter is operated in any modes, the up and down movement of the bin unit is stopped regardless of the position of the bin unit at the time when the finally discharged paper is contained in a predetermined bin of the sorter. Then, the sorter is on standby in this state until all discharged papers contained in the respective bins are extracted by a user. Thereafter, the sorter is returned to the home position. Therefore, in a case that the finally discharged paper corresponds to the bin of the uppermost stage, the bin unit in which the discharged papers are contained in the respective bins is stopped at the lowest position (in a state that the bin unit is moved down lowest).

This brings about a problem in which a hard working posture to take out the discharged paper is required of a user working close to the image reading section of the copy machine. Moreover, in a case that the side surface of the sorter is provided close to the wall, there is a problem in which a space necessary to take up discharged papers is not easily ensured.

Separately from the above problems, in a case that two or more sorters (coupling type of sorter) are used at the same time, there occurs a problem in which the sorter, which is provided at a portion away from the image forming section is hindered, the user taking up the discharged papers from the sorter, which is provided at a portion close to the image forming section.

SUMMARY OF THE INVENTION

An object of the present invention is to provide an image forming apparatus having high operability.

Another object of the present invention is to provide an image forming apparatus wherein discharged papers discharged from the image forming apparatus and contained in a copying material containing apparatus can be easily extracted from the copying material containing apparatus.

Further another object of the present invention is to provide a sorter, which can be mounted in a narrow space (mounting space), and can easily extract sorted and contained discharged papers.

According to a first aspect of the present invention, there is provided an image forming apparatus with a plurality of sorters, comprising a main body of the image forming apparatus for forming an image on paper, and discharging the paper on which the image is formed; a first sorter, connected to the main body of the image forming apparatus, for containing the image formed paper discharged from the main body of the image forming apparatus, the first sorter having a plurality of bins for containing the paper and storing means with a first height having the plurality bins attached; and a second sorter, connected between the first sorter and the main body of the image forming apparatus, for containing the image formed paper discharged from the main body of the image forming apparatus, the second sorter having storing means with a plurality of bins for containing the paper and a motor for moving the storing means to a position at least higher than the first height when the image formed paper discharged from the main body of the image forming apparatus is contained in the plurality of bins of the storing means.

According to a second aspect of the present invention, there is provided an image forming apparatus with a plurality of sorters, comprising a main body of the image forming apparatus for forming an image on paper, and discharging the paper on which the image is formed; a first sorter with a predetermined height, provided at the farthest away from the main body of the image forming apparatus, among a plurality of sorters, connected to the main body of the image forming apparatus, for containing the image formed paper discharged from the main body of the image forming apparatus; a second sorter, connected between the first sorter and the main body of the image forming apparatus, for containing the image formed paper discharged from the main body of the image forming apparatus, the second sorter having storing means with a plurality of bins arranged in upper and lower directions to contain the paper; and a motor for moving the storing means such that the bin positioned at the lowest of all bins containing the image formed papers is placed at a position higher than the predetermined height when the image formed paper discharged from the main body of the image forming apparatus is contained in the second second sorter.

According to a third aspect of the present invention, there is provided an image forming apparatus with a plurality of sorters, comprising image forming means for forming an image on paper; a main body of the image forming apparatus having a first discharge port for discharging paper on which the image is formed by the image forming means; a first sorter, connected to the main body of the image forming apparatus, having a first height, for containing the image formed paper discharged from the first discharge port; the first sorter having storing means with a plurality of bins for containing the image formed paper, a motor for moving the storing means, and a second discharge port for discharging the image formed paper discharged from the first discharge port to a lower stream; a second sorter, provided to be connectable to the first sorter, having a second height higher than the first height, for containing the image formed paper discharged from the first discharge port of the first sorter when being connected to the first sorter; and control means for controlling the first sorter such that the storing means is moved until the bin provided at the lowest position of all bins containing the image formed papers of the storing means of the first sorter reaches a position at least higher than the height of the second sorter when all image formed papers are contained in the first sorter after the end of the image forming operation by the image forming means of the main body of the image forming apparatus.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

An embodiment of the present invention will be explained with reference to the drawings.

Figure 1:
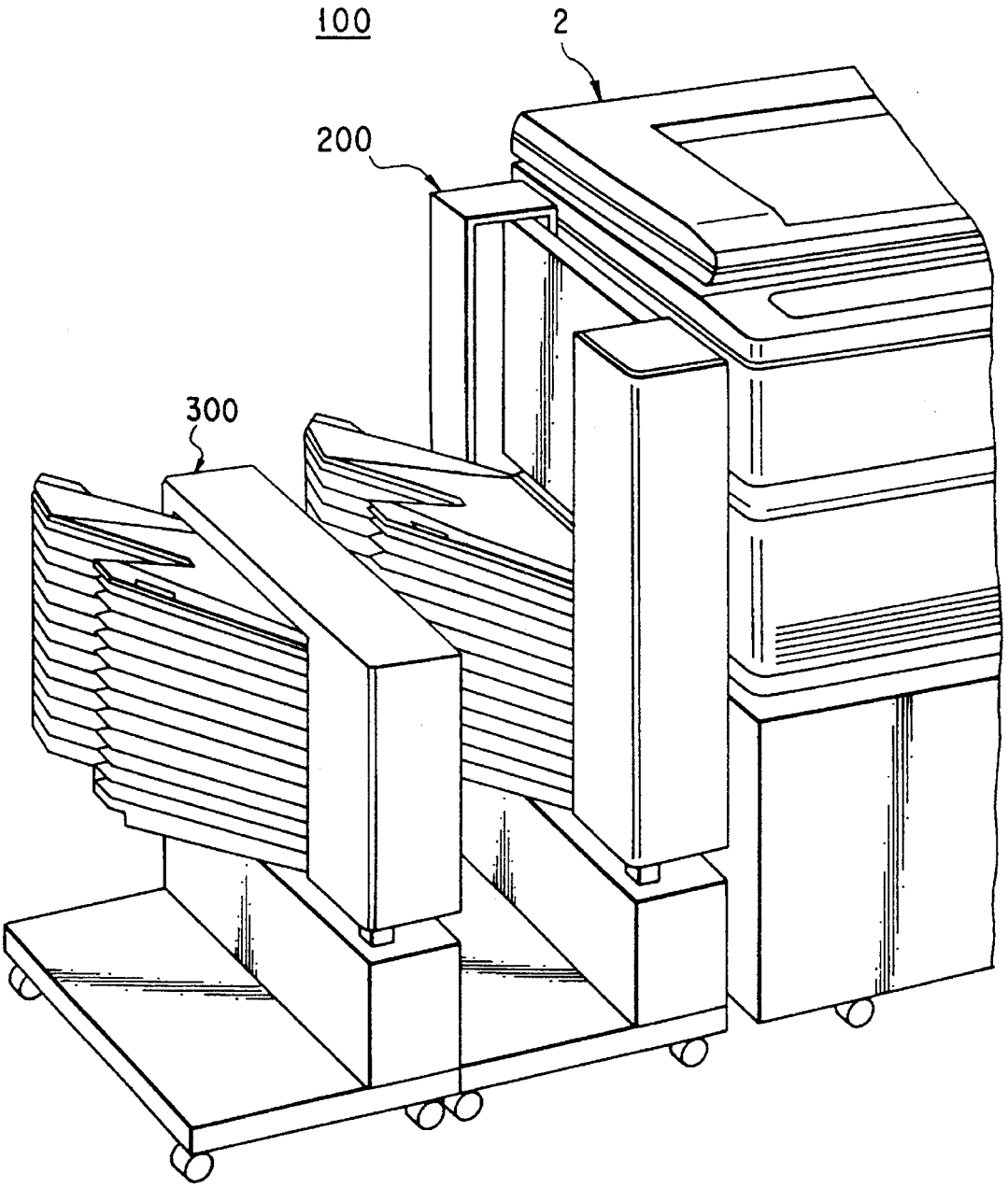
FIG. 1 is a schematic view showing a copying machine with a sort unit in which the embodiment of the present invention is incorporated.

In FIG. 1, an image forming device, that is, an electronic copying machine with sorters 100 has an image forming section for copying an image of an original onto a sheet paper and discharging it, that is, a main body 2 of the copying machine, first and second storing devices for sorting and storing the discharged papers discharged from the main body 2 of the copying machine in accordance with a predetermined mode, that is, first and second sorters 200 and 300. In a case that the number of the discharged papers is larger than the sorting capacity of the first sorter 200, the number of discharged papers exceeding the sorting capacity of the first sorter 200 is transported to the second sorter 300 in order.

Figure 2:
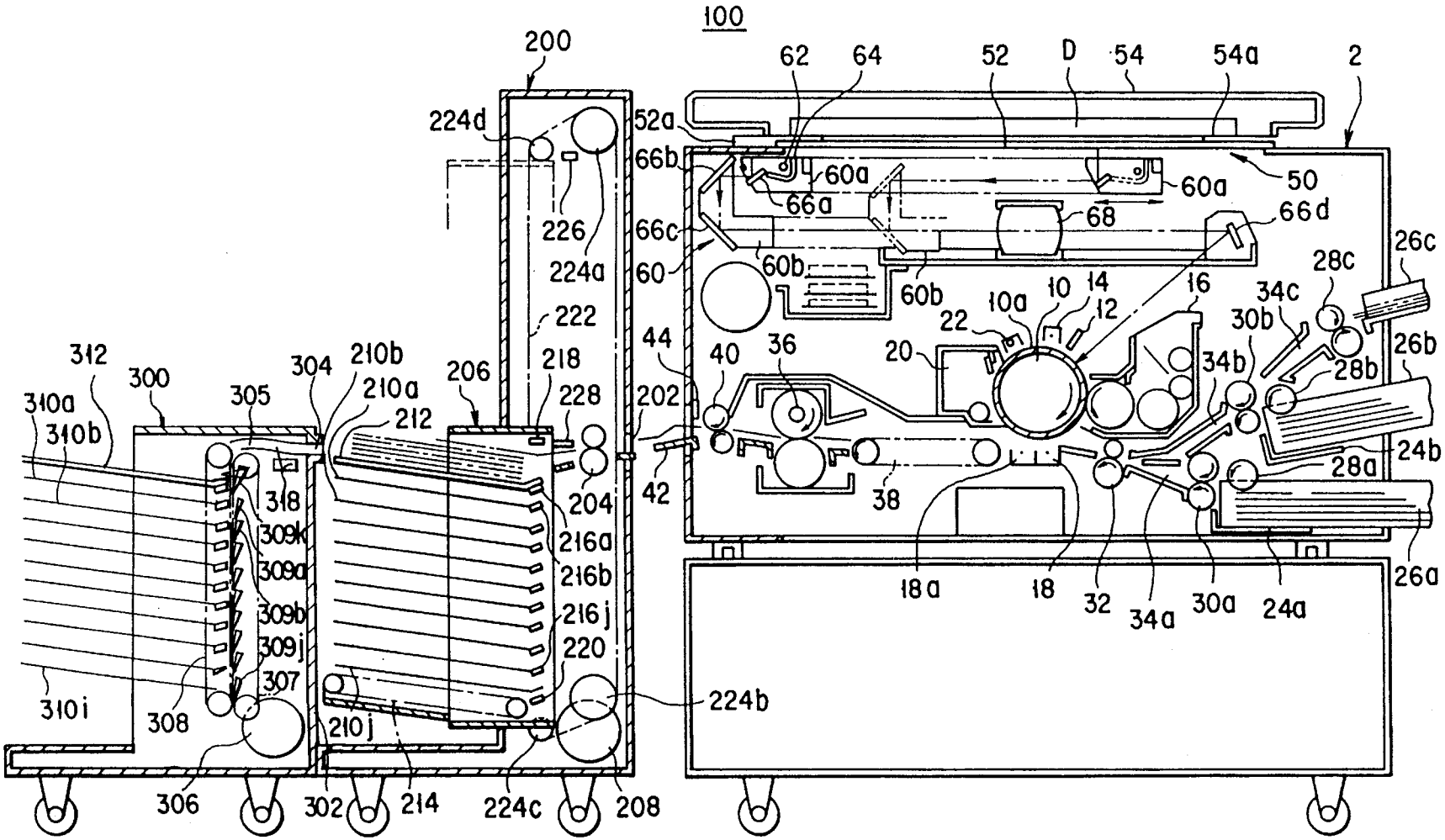
FIG. 2 is a schematic cross section of the copying machine with a sort unit of FIG. 1.

According to FIG. 2, the main body 2 of the copying machine has a photosensitive drum 10 provided at substantially the central portion of the main device itself to be rotatable in a direction of an arrow by a driving motor (not shown). In the photosensitive drum 10, a thin layer, made of amorphous silicon, of the photosensitive drum, that is, a photosensitive layer 10*a* is formed on an outer periphery of a cylinder made of, e.g., aluminum. The photosensitive drum 10 can provide a distribution pattern of electrical charge, that is, electrostatic latent image by irradiating the photosensitive layer 10*a* with light in a state that a predetermined potential is applied thereto.

A charging width controller 12, a charger 14, a developing unit 16 and a transferring unit 18, a cleaning unit 20, and a discharging unit 22 are arranged around the photosensitive drum 10 in order along a direction where the photosensitive drum 10 is rotated.

In a right side of the main body 2, a plurality of slots 24*a* and 24*b* through which paper cassette to be described later is inserted are formed. Paper cassettes 26*a* and 26*b* are inserted to the slots 24*a* and 24*b* to Supply a sheet paper to the photosensitive drum 10. A bypass tray 26*c*, which can dispersively feed the papers, is provided at the upper portion of the paper cassette 26*b*. First and second paper feeding rollers 28*a* and 28*b*, a bypass paper feeding roller 28*c*, first and second transferring rollers 30*a* and 30*b*, and a pair of timing rollers 32 are arranged in order among the photosensitive drum 10, paper cassettes 26*a*, 26*b* (slots 24*a*, 24*b*), and the bypass tray 26*c*. Feeding paths 34*a*, 34*b*, and 34*c*, each formed of a pair of guide plates, for guiding papers directing to the photosensitive drum 10 are provided among the timing roller 32, the respective paper feeding rollers 28*a*, 28*b*, and 28*c*. The timing roller 32 corrects the inclination of the paper, matches the top end of the image formed on the photosensitive drum 10 with that of the paper, and feeds the paper at the same speed as the rotation speed of the photosensitive drum 10.

At a position which is relatively away from the photosensitive drum 10, and in a direction where the paper onto which a toner image is transferred by the transferring unit 18, there is provided a fixing unit 36 for fixing toner (image), which is electrostatically adhered onto the paper, to the paper.

A conveying belt 38 for conveying the paper on which the toner image is transferred by the transferring unit 18 to the fixing unit 36 is provided between the transferring unit 18 and the fixing unit 36.

In a direction where the paper onto which the toner image is fixed by the fixing unit 36 is further sent, there are arranged a discharge roller 40, a discharge guide 42, and a discharge sensor 44. The discharge roller 40 discharges the paper onto which the toner image is fixed by the fixing unit 36 to the outer unit of the main body 2. The discharge guide 42 guides the discharged papers each having the fixed toner image, which are sent from the main body 2 through the discharge roller 40, to the first sorter 200. The discharge sensor 44 detects that the discharged papers, which are directed from the main body 2 to the outer unit of the device, is passed through the discharge roller 40.

At the upper portion of the photosensitive drum 10, there are provided an original mounting portion 50 on which the original is mounted and an original reading section 60 for transmitting an image of the original mounted on the original mounting portion 50 is the photosensitive layer 10*a* of the photosensitive drum 10. Also, there is provided a control panel (not shown), which is used to input copying conditions and a copy starting signal for starting a copying operation, in the vicinity of the original mounting portion 50 and at an outer cover (not shown) covering the main body 2.

The original mounting portion 50 includes an original table 52 for holding the original, and a pressing cover 54 for pressing the original to the original table 52. At one end of the original table 52, there is provided a designation board 52*a* for designating the position of the original to be mounted on the original table 52. Moreover, a sponge or an elastic mat 54*b* such as rubber is adhered to the inside of the pressing cover 54 so as to close the original to the original table 52.

The original reading section 60 includes an illumination lamp 62 for illuminating the original mounted on the original table 52, a reflector 64 for guiding light from the illumination lamp 62 on a predetermined position, reflecting mirrors 66*a*, 66*b*, 66*c*, and 66*d* for transmitting reflection light (image data) from the original to the photosensitive layer 10*a* of the photosensitive drum 10, and a lens 68, provided between the reflecting mirrors 66*c* and 66*d*, for stabilizing an optical property of the reflected light from the original. The illumination lamp 62, reflector 64, and reflecting mirror 66*a* are assembled as one unit as a first carriage 60*a*. Similarly, the reflecting mirrors 66*b* and 66*c* are assembled as one unit as a second carriage 60*b*. Moreover, the first carriage 60*a* is moved to be parallel to the original table 52 at the speed corresponding to a copy magnification by which the original is copied by a belt (not shown) or a wire. The second carriage 60*b* is moved in a direction which is a same direction with the first carriage 60*a* is moved at a half speed of the first carriage 60*a*.

The structure of the first sorter 200 and that of the second sorter 300 will be explained as follows.

The first sorter 200 includes an intake 202, a pair of conveying rollers 204 for conveying the discharged papers transferred by the intake 202, and a bin unit 206 for containing the discharged papers conveyed by the covey rollers 204. The bin unit 206 is moved up and down by a lift motor 208 relative to the conveying rollers 204.

The bin unit 206 has a plurality of paper trays, that is, bins 210*a*, 210*b* . . . 210*j*, (ten trays in this embodiment). The bin unit 206 has a discharge tray 212 containing all discharged papers at the time of non-sort storing, that is, non-sort mode is positioned at the upper portion of the bin 210*a* of the uppermost section. At the lower portion of the bin 210*j* of the lowermost section, there is provided a paper transporting device 214 for transporting the discharged paper to the second sorter 300 when the number of copies cannot be contained in all of the bins of the bin unit 206 of the first sorter 200, that is, the number of copying papers exceeds 11. Each of bins 210*a*, 210*b*, . . . 210*j* is formed such that 50 discharged papers can be contained therein. Also, the discharge tray 212 is formed such that 250 discharged papers can be contained therein.

At the position opposite to each of bins 210*a*, 210*b*, . . . 210*j*, there are provided paper sensors 216*a*, 216*b*, . . . 216*j*, respectively. The paper sensors 216*a*, 216*j* may be arranged at individual bins, respectively, depending on the structure of the device. Also, JAM sensors 218 and 220 are provided at the discharge tray 212 and the paper transferring device 214, respectively.

A driving belt 222 is provided between the lift motor 208 and the bin unit 206 so as to transmit rotational power of the motor 208 to the bin unit 206, and to relatively move the bin unit 206 to the conveying rollers 204. The driving belt 222 is maintained to be rotatable clockwise or anticlockwise by pulleys 224*a* to 224*d*.

At a portion, which is close to the pulley 224*d* and is the highest position where the bin unit 206 can be moved up, there is provided a position sensor 226 for detecting that the bin unit 206 is moved up to the highest position. The position sensor 226, which optically detects the arrival of the bin unit 206, may be used. Or, there may be used the position sensor in which an actuator is pressed up by the bin unit 206 thereby detecting the arrival.

A transfer sensor 228 is provided between the conveying rollers 204 and the bin unit 206 so as to detect that the discharged paper sent from the discharge roller 40 of the main body 2 is contained neither any of bins 210*a* . . . 210*j* nor discharge tray 212, that is, paper jam.

The second sorter 300 includes a main body 302 having a height which is smaller than the first sorter 300, an intake 304, a discharged paper guide 305 for guiding the discharged papers fed by the intake 304, a pair of guiding belts 307 and 308 for transporting the dis charged papers guided by the paper guide 305. The guiding belts 307 and 308 are moved predetermined direction by a motor 306.

The main body 302 has a plurality of paper trays, that is, bins 310*a*, 310*b* . . .. 310*j*, (ten trays in this embodiment). The main body 302 has a discharge tray 312 containing all copied papers at the time of non-sort storing, is positioned at the upper portion of the bin 310*a* of the uppermost section. Each of bins 310*a*, 310*b*, 310*j* is formed such that 50 discharged papers can be contained therein. Also, the discharge tray 312 is formed such that 250 discharged papers can be contained therein.

In an inner portion of the guiding belts 307 and 308, a plurality of flaps 309*k*, 309*a*, . . . 309*j* are located. Each of the flaps 309*k*, 309*a*, . . . 309*j* is projected a space defined inside of the guiding belts 307 and 308 by clutches 311*k*, 311*a*, . . . 311*j* (shown in FIG. 3), and to direct the discharged papers discharged from the first sorter 200 to each of the bins 310*a* to 310*j* and the tray 312.

At the position opposite to each of bins 310*a*, 310*b* . . .. 310*j*, there are provided paper sensors 316*a*, 316*b*, . . . 316*j*, respectively. The paper sensors 316*a*, 316*j* may be arranged at individual bins, respectively, depending on the structure of the device. Also, JAM sensor 318 is provided at the discharge tray 312.

Figure 3:
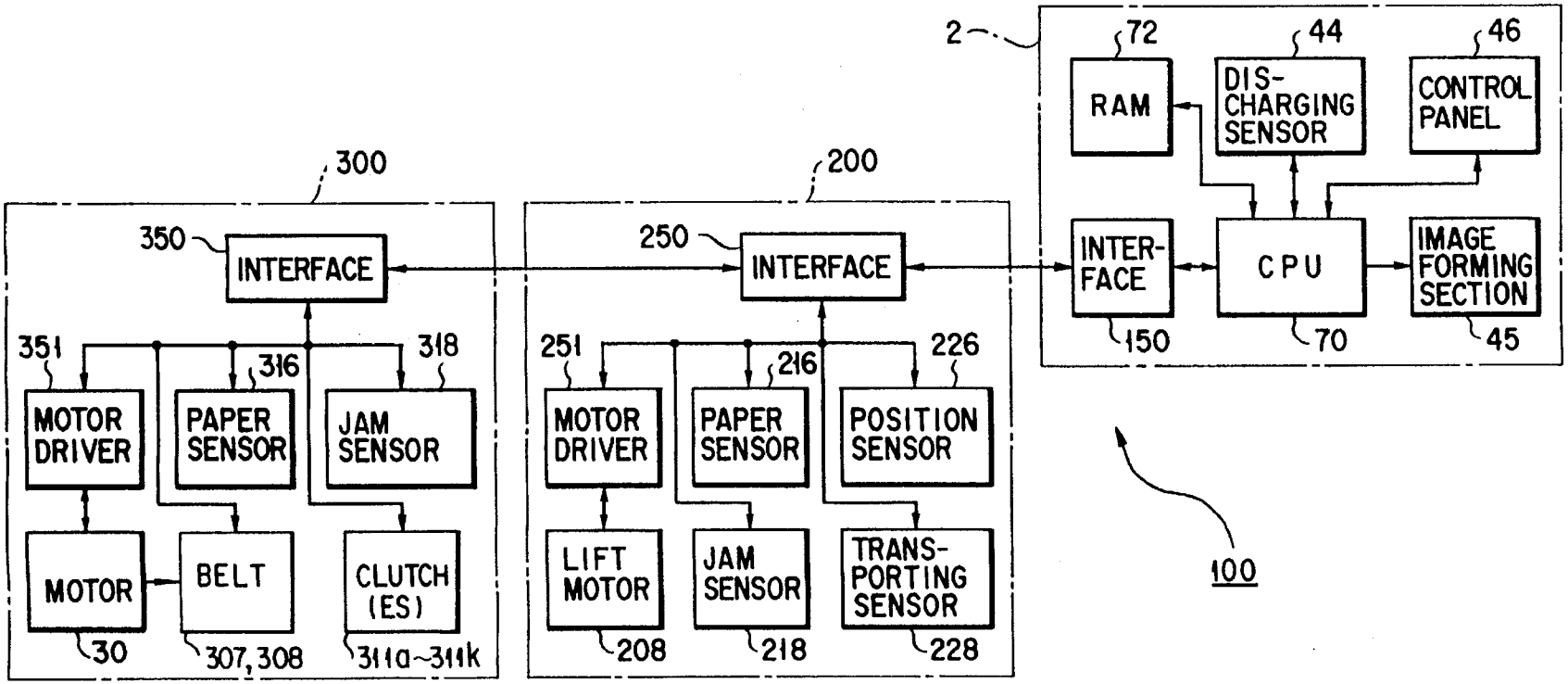
FIG. 3 is a schematic block diagram of the copying machine with a sort unit of FIG. 1.

FIG. 3 is a block diagram showing an electrical connecting state of the embodiment of the present invention.

In the main body 2 of the copying machine, a CPU 70, serving as a main controller for controlling the main body 2, is provided. The respective devices or an electrical circuit group included in the main device 2, e.g., image forming means 45, which includes the devices used to copy the image of the original such as the charging unit 14, developing device 16, and transferring unit 18 as one unit, a discharge sensor 44 for detecting that paper is discharged from the main body 2, a control panel 46 for various settings and displays are connected to the CPU 70. Moreover, the first and second sorters 200 and 300 are connected to the CPU 70 through an interface 150, and controlled by the CPU 70.

The first sorter 200 is connected to the interface 150 of the main body 2 through an interface 250. The interface 250 is connected to the paper sensors 216*a*, 16*b*, . . . 216*j* of the first sorter 200, the JAM sensors 218 and 220, the position sensor 226, the transfer sensor 228, and the motor driver 251. Whereby, the first sorter 200 is driven by the control of the CPU 70 of the main body 2.

Similar to the first sorter 200, paper sensors 316*a*, 316*b*, . . . 316*j* of the second sorter 300, a JAM sensors 318, a plurality of clutches 311*k*, 311*a* . . . 311*j*, and a motor driver 351 are connected to an interface 350. Moreover, a motor 306 is connected to the motor driver 351.

The interface 350 is connected to the CPU 70 of the main body 2 through the interface 250 of the first sorter 200, and the interface 150 of the main body 2. Whereby, the second sorter 300 is also controlled by the CPU 70 of the main body.

The features of the operation of the copying machine 100 with sorter will be explained as follows:

A power switch (not shown) of the main body 2 is operated, thereby warming up the main body 2, and setting a standby state (copying state).

More specifically, a main motor (not shown) and a developing motor (not shown) are driven through a motor driving circuit 351 by the control of the CPU 70, so that the photosensitive drum 10 and the developing unit 16 are rotated. At the same time, the charging unit 14, transferring device 18, and discharging unit 22 are driven through a high voltage generating circuit (not shown) and a discharging unit driving circuit, thereby aging the photosensitive layer 10*a* of the photosensitive drum 10. And also, a heater lamp of the fixing unit 36 is turned on and to start a heating of the heat roller of the fixing unit 36.

By the control panel, the number of copying papers, the magnification, and the sorting/storing mode such as the sort mode in which the discharged papers are sorted in order of page of the original and contained, and the group mode in which the discharged papers of the same page of the original are grouped together and contained.

A copy starting key (not shown) is operated, so that the photosensitive drum 10 is rotated, the discharging unit 22, the charging width controller 12 and the charging unit 14, and a predetermined amount of electrical charge is supplied to the photosensitive layer 10*a* of the photosensitive drum 10. In other words, the photosensitive layer 10*a* is charged to a predetermined potential.

Under this state, the illumination light 62 is turned on, and the first and second carriages 60*a* and 60*b* are moved to be parallel to the original table 52, whereby an electrostatic latent image corresponding to the image of the original is formed on the photosensitive layer 10*a*. At the same time, a paper, which is fed from one of the paper cassettes 26*a* and 26*b* and the bypass tray 26*c*, is conveyed to the timing roller 32.

On the other hand, the electrostatic latent image formed on the photosensitive layer 10*a* of the photosensitive drum 10 is conveyed to a developing position where the developing unit 16 is brought into contact with the photosensitive layer 10*a* with the rotation of the photosensitive drum 10. Then, toner (not shown) is supplied thereto through the developing unit 16, thereby converting toner to a toner image, that is, developing toner to a toner image. In a state that the top end of the paper stopped by the timing roller 32 and that of the toner image are matched with each other, the toner image is conveyed to a transferring area formed between the transferring unit 18 and the photosensitive drum 10 together with the paper moved from the timing roller 32, and transferred to the paper through the transferring unit 18. The photosensitive drum 10 on which the toner image is transferred is sequentially rotated, and toner left on the photosensitive layer 10*a* is removed by the cleaning unit 20. Thereafter, the distribution state of the electric charge is neutralized by the discharging unit 22, and the neutralized distribution state of the electric charge is used for forming next latent image. The paper to which the toner image is transferred is conveyed to the fixing unit 36 by the conveying belt 38, the toner image is thermally fixed by the fixing unit 36, and discharged to the first sorter 200 by the discharging roller 40.

The above series of the operations is sequentially repeated a predetermined number of times in accordance with the number of copying papers inputted by the control panel.

The discharged papers discharged from the the main body 2 through the discharge roller 40 are contained in the first sorter 200, bins 210*a* . . . 210*j* of the first sorter 200 and bins 310*a* . . . 310*j* of the second sorter 300, or the discharge tray 212 in accordance with the sort mode inputted by the control panel.

Figure 4:
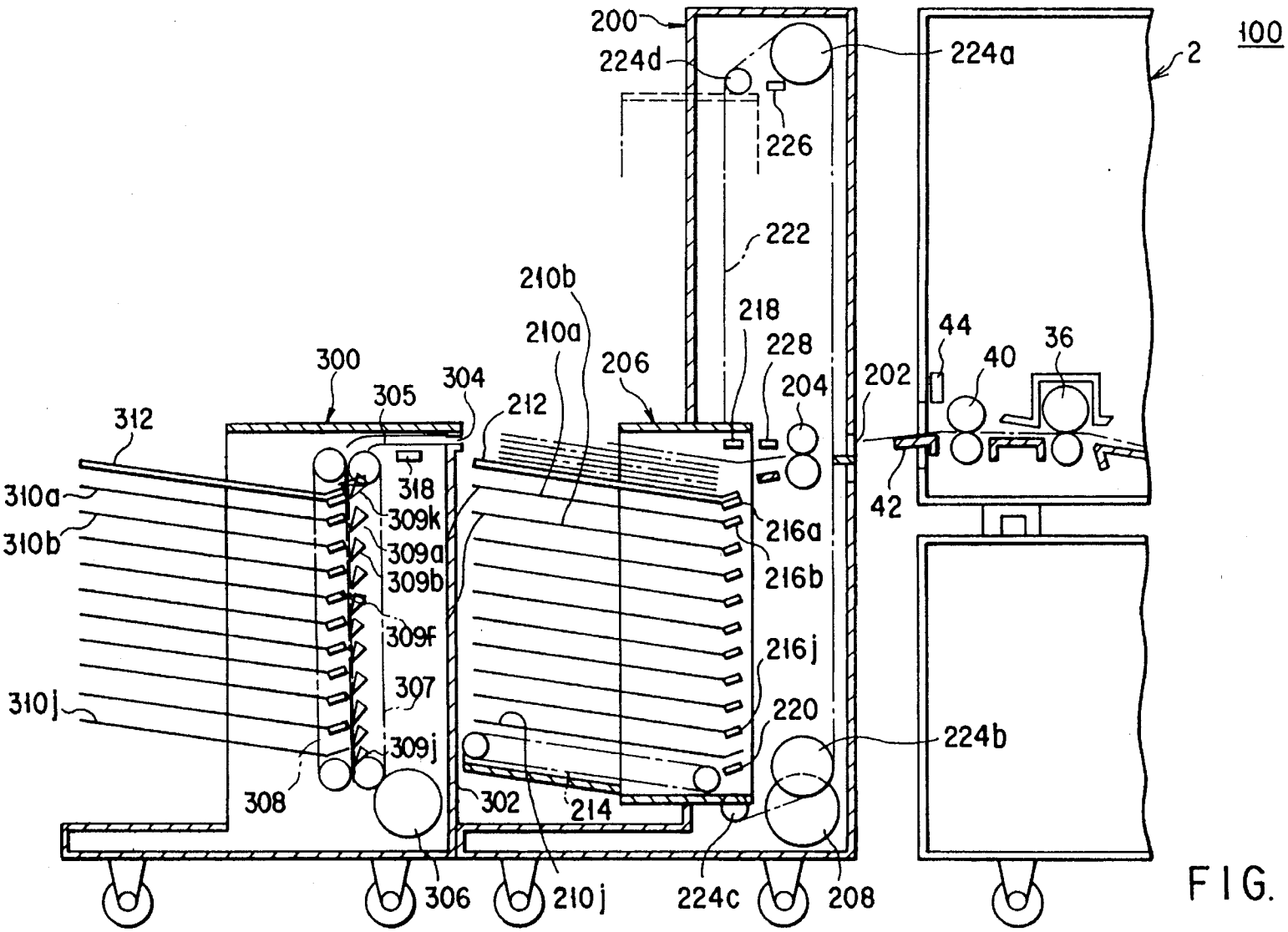
FIG. 4 is a schematic view showing one example of an operating state of the copying machine with a sort unit of FIGS. 1 to 3.

FIG. 4 is an example of the series of operation of the first and second sorters 200 and 300, and shows the state that the discharged papers are contained in the non-sort mode (non-sorting operation). In this case, 250 discharged papers can be contained in the discharge tray 212, and 50 discharged papers can be contained in each of bins 210*a* to 210*j* and 310*a* to 310*j*. More specifically, the discharged papers discharged from the main body are all contained in the discharge tray 212 (non-sort bin) of the first sorter 200. In a case that discharged papers exceeds 251, the lift motor 208 is driven and the bin unit 206 is lifted by one bin in the direction of the pulley 224*d*, and two hundred and first to three hundredth papers are contained in the bin 210*a*. Thereafter, similarly, the discharged papers are sequentially contained by 50 discharged papers in each of bins 210*b* to 210*j* and 310*a* to 310*j*. Therefore, in the non-sorting mode, 750 discharged papers can be contained in the first sorter 200 at maximum. Also, a signal line (not shown) is ensured, whereby the discharged papers can be similarly conveyed to the second sorter 300. In this case, 1500 discharged papers of the same original can be sequentially obtained.

Figure 5:
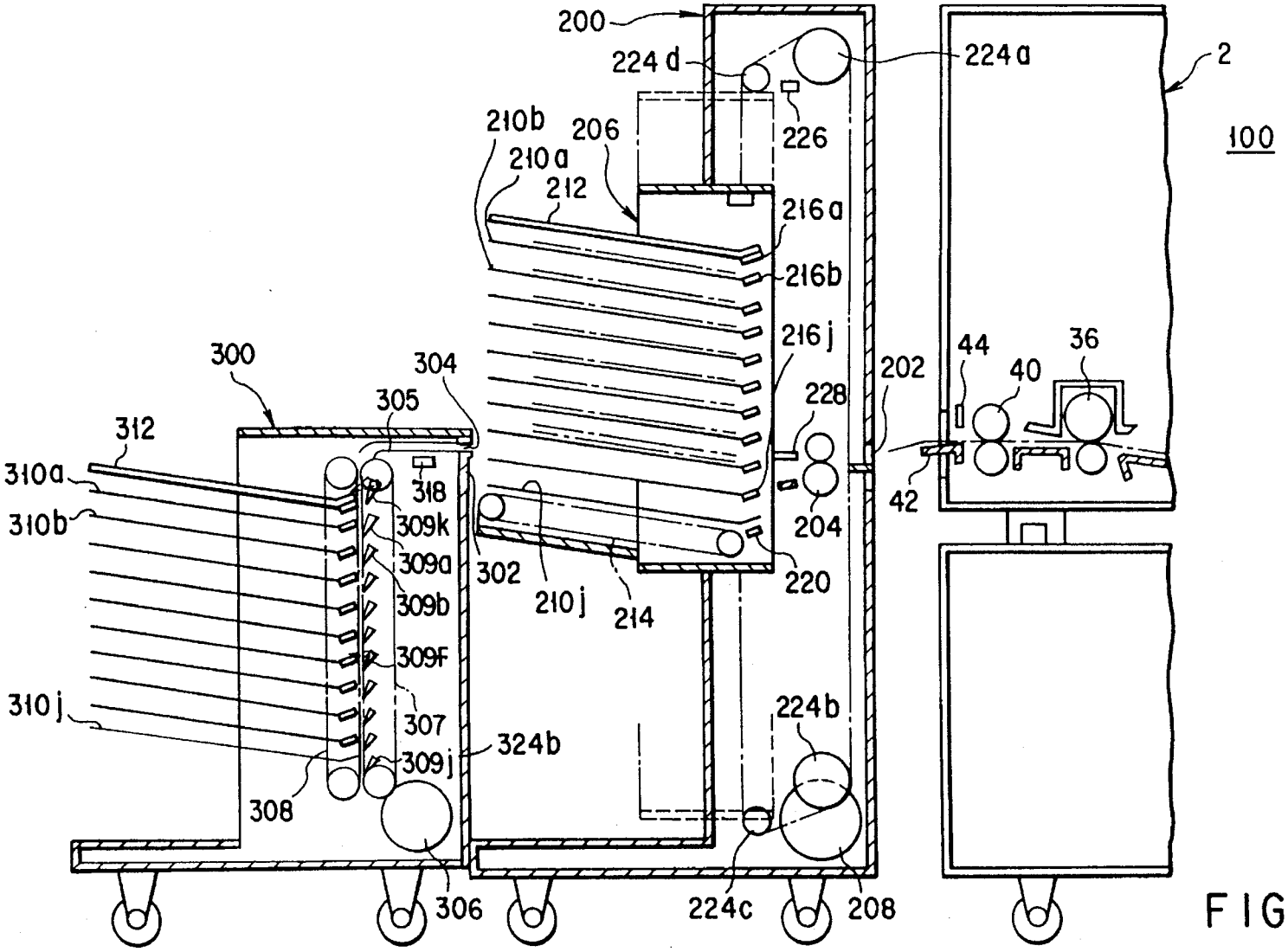
FIG. 5 is a schematic view showing another example of an operating state of the copying machine with a sort unit of FIGS. 1 to 3.
Figure 6:
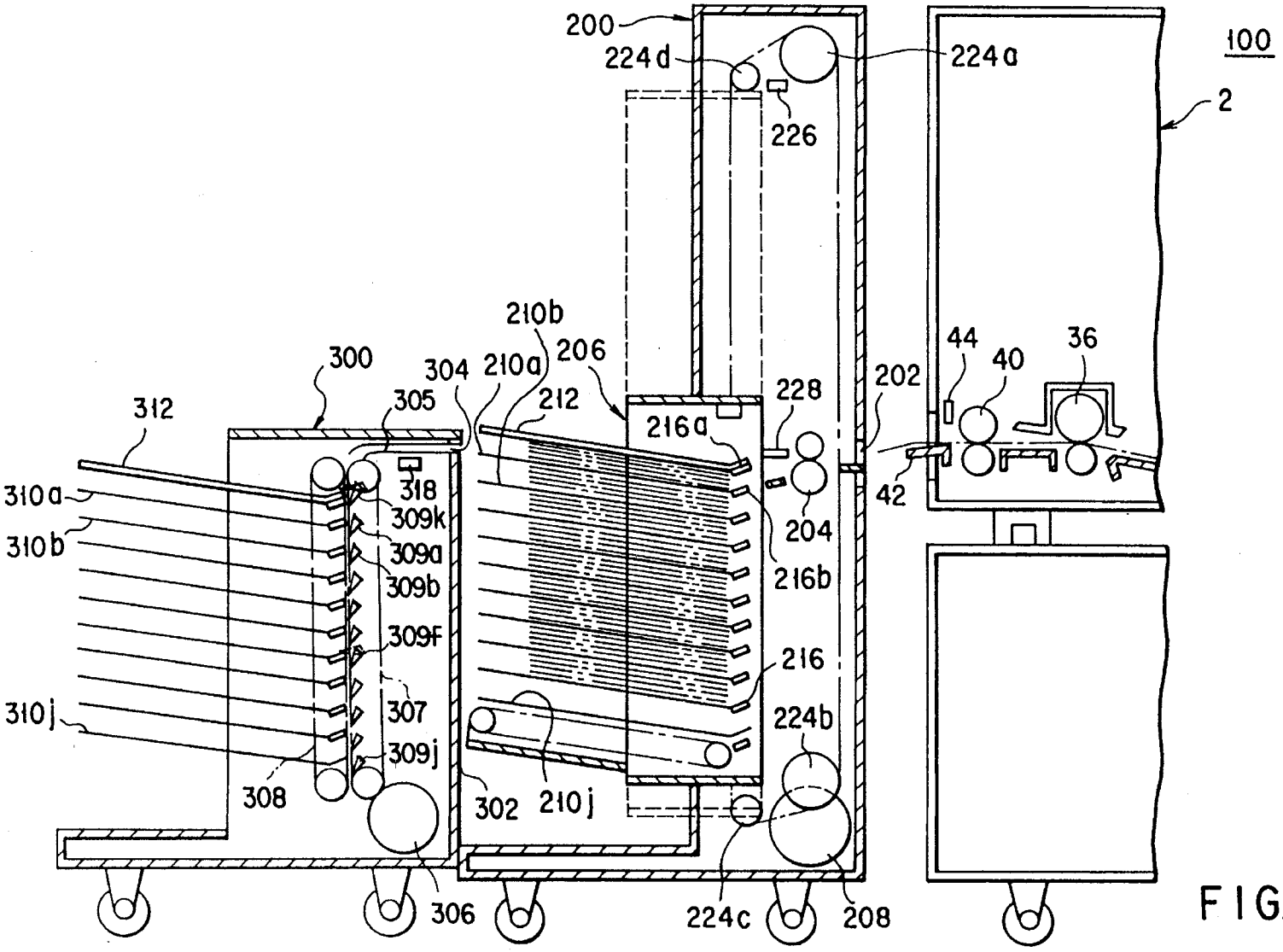
FIG. 6 is a schematic view showing one example of an operation state sequentially after the operating state shown in FIG. 5.
Figure 7:
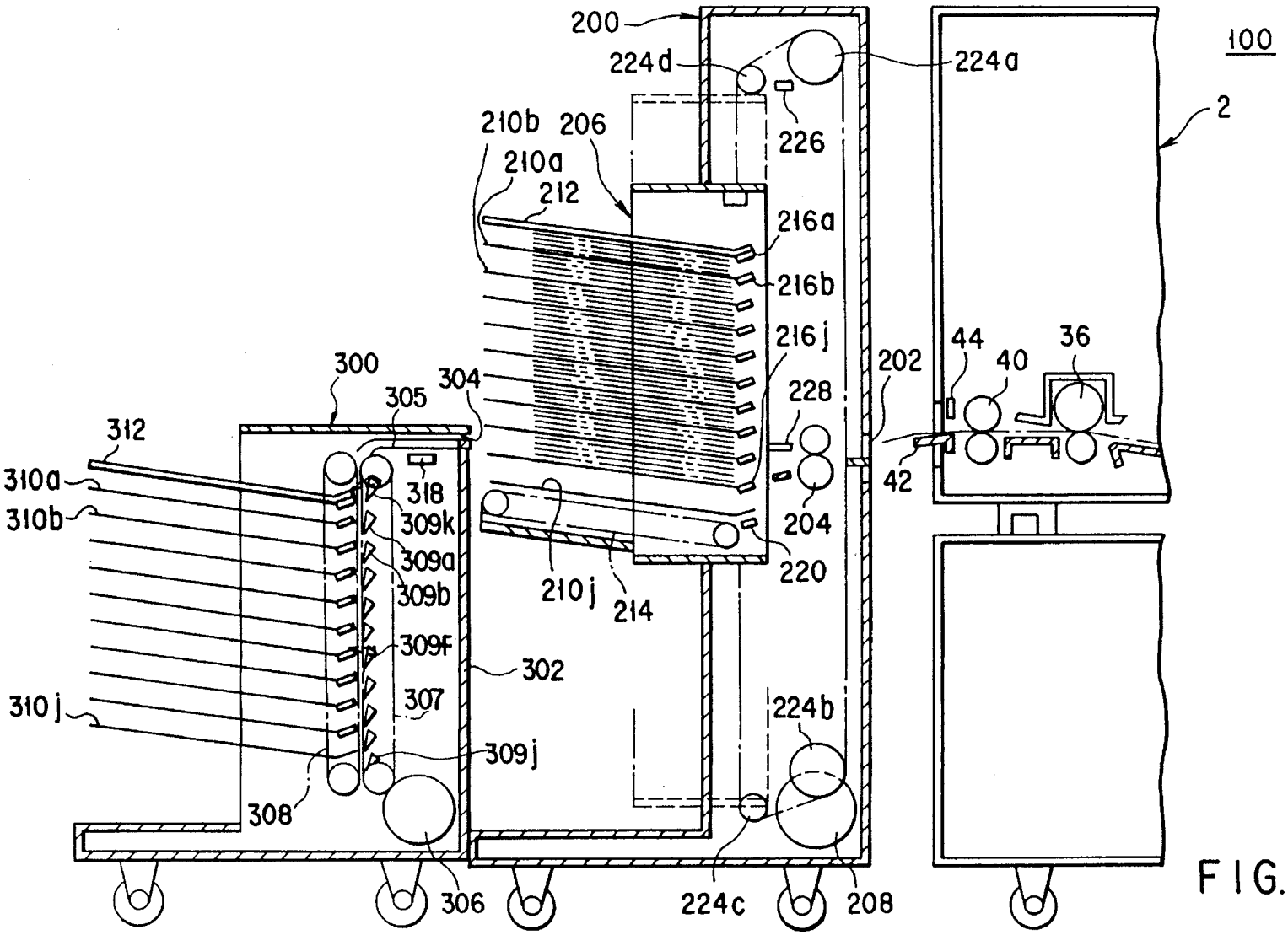
FIG. 7 is a schematic view showing one example of an operation state sequentially after the operating state shown in FIG. 6.

FIGS. 5 to 7 show an example of an operation of the sorter in the sort mode in which the discharged papers are sorted in order of the page of the original to be contained.

In FIGS. 5 to 7, a case that the number of originals is four, and the number of sets of copies is nine is shown.

The first discharged paper of the first original is sent to the intake 202 of the first sorter 200 by the discharge roller 40 of the main body 2, and introduced to the sorter 200. The first discharged paper introduced to the sorter 200 through the intake 202 is contained in the bin 210*a* whose position is matched with the conveying rollers 204 through the lift motor 208 in advance prior to the timing when the leading head of the discharged paper is arrived to the conveying rollers 204. At this time, it is detected by the conveying sensor 228 and the paper sensor 216*a* that the first discharged paper is contained in the bin 210*a*.

Sequentially, the bin unit 206 is lifted by one bin in the direction of the pulley 224*d* by the lift motor 208. Therefore, the bin 210*b* is placed at the position where the paper is conveyed by the conveying rollers 204. Whereby, the second discharged paper is contained in the bin 210*b*. At the same time, it is detected by the conveying sensor 228 and the paper sensor 216*b* that the second discharged paper is contained in the bin 210*b*.

Similarly, the discharged paper, which is fed in a predetermined order, is conveyed to the bin placed at the position to which the paper corresponds. Then, the bin unit 206 is lifted by one bin, and the third discharged paper and the following are supplied to the bin 210*c* . . . bin 210*i* in order.

At the time when the ninth discharged paper is contained in the bin 210*i* (that is, time when it is detected by the discharge sensor 44, conveying sensor 228, and paper sensor 216*i* that the discharged paper is contained), the image of the second original (not shown) is copied. At this time, the lift motor 208 is stopped. Then, the state that the position of the bin 210*i* and the position where the paper is conveyed by the conveying rollers 204 are matched is maintained until the first discharged paper of the second original is contained in the bin 210*i*.

At the time when the first discharged paper of the second original is passed through the paper sensor 216*i*, the lift motor 208 is driven, and the bin unit 206 is moved down by one bin in the direction of the pulley 224*c*. In other words, the bin 210*h* is placed at the position where the paper is conveyed by the conveying rollers 204. Whereby, the second discharged paper of the second original is contained in the bin 210*h*.

Similarly, the discharged paper, which is fed in a predetermined order, is conveyed to the bin placed at the position to which the paper corresponds. Then, the bin unit 206 is moved down by one bin, and the third discharged paper and the following are supplied to the bin 210*g* . . . bin 210*b*, 210*a* in order.

In this case, since the number of original is four (even number), as shown in FIG. 6, the bin unit 206 is stopped at the position where the bin unit 206 is moved down to the lowermost position when the copying is ended.

At this time, when the CPU 70 detects that a predetermined time is passed after paper is finally passed through the discharge sensor 44, whereby the end of copying is confirmed. Moreover, it is confirmed by the transfer sensor 228, JAM sensor 218, and paper sensor 216*a* to 216*i* that all papers are contained in the bin unit 206 of the first sorter 200. Moreover, after passing a predetermined time, a next copying operation is prohibited, and the lift motor 208 is driven, and the bin unit 206 is moved to a predetermine position in the direction of the pulley 224*d*.

The bin unit 206 is moved up to the position as shown in FIG. 7, and stopped. In this example, the position where the bin unit 206 is stopped is defined by the bin 210*i* of the lowermost portion used at the position where the paper is conveyed through the conveying rollers 204. According to this method, in moving up the bin unit after the end of the copying, no new position data is needed. In other words, the bin unit 206 is moved up based on data of the number of copying (by which the number of bins to be used is determined) inputted to a temporarily storing device (RAM 72). In this case, the position where the bin unit 206 is moved up may be the position of the paper transporting device 214 regardless of the number of copying papers or the position where the bin unit 206 is moved up may be the position of a top of the second sorter 300 (having a predetermined height smaller than the first sorter 200).

In a case that the number of originals is three, at the time when all copying is ended, the bin unit 206 is stopped in a state that the bin 210*i* and the conveying rollers 204 are opposite to each other. Therefore, if the number of originals is odd, the bin unit 206 is stopped in a state it is moved upward as shown in FIG. 7. In this case, it is recognized that a predetermined time is passed after paper is finally passed through the discharge sensor 44, whereby the end of copying is confirmed. Moreover, it is confirmed by the transfer sensor 228, JAM sensor 218, and paper sensor 216*a* to 216*i* that all papers are contained in the bin unit 206 of the first sorter 200. Thereafter, the bin unit 206 is maintained to be in the moved-up state until all papers are extracted through the paper sensors 216*a* to 216*i*. In other words, in the case that data of the number of copying papers stored in RAM 72 is odd, the bin unit 206 may be stopped at the present position as it is. Needless to say, the position where the bin unit 206 is moved up may be the position of a top of the second sorter 300, also.

A second embodiment of the present invention will be explained with reference to the drawings.

Figure 8:
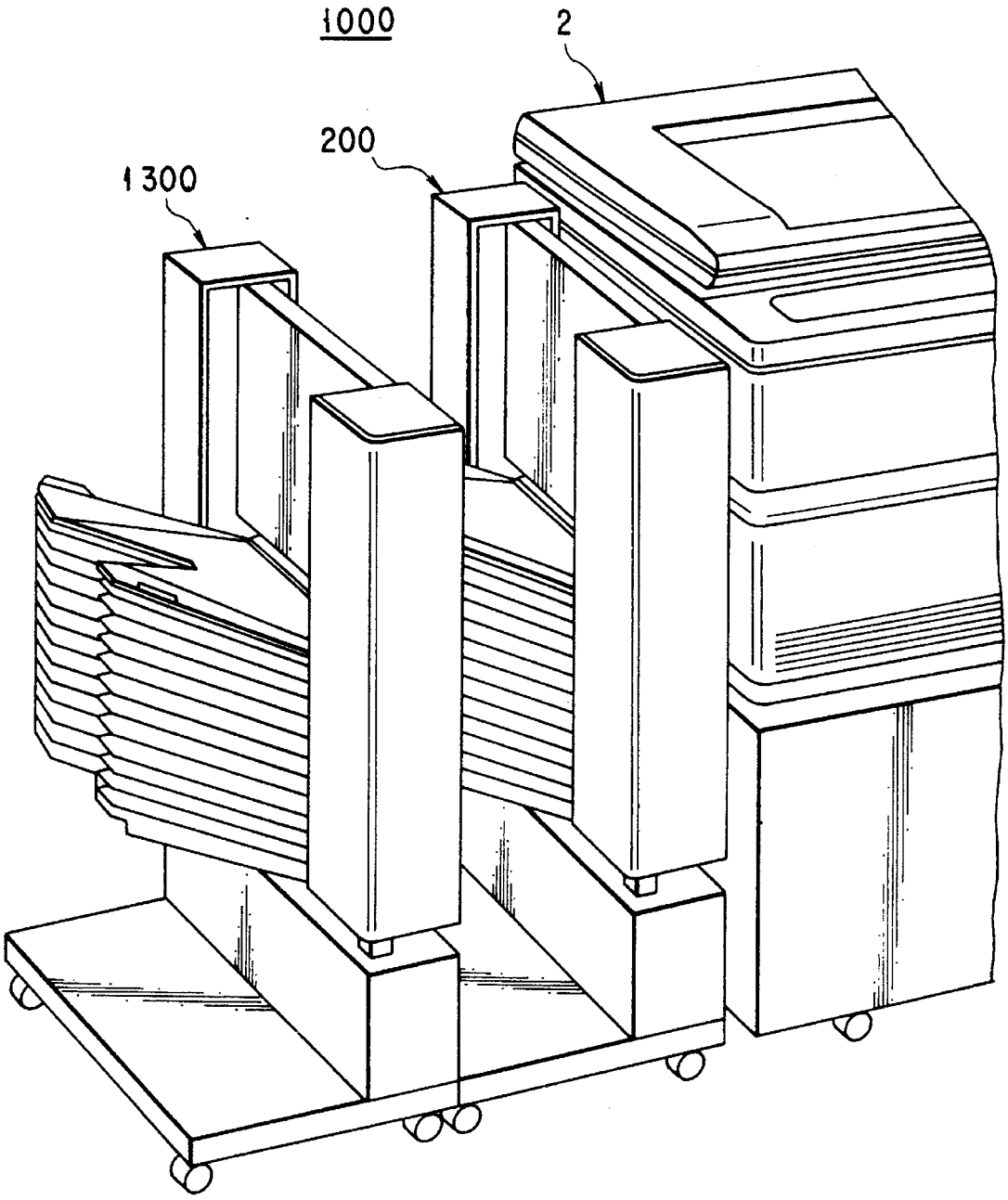
FIG. 8 is a schematic view showing a copying machine with a sort unit in which the second embodiment of the present invention is incorporated.
Figure 9:
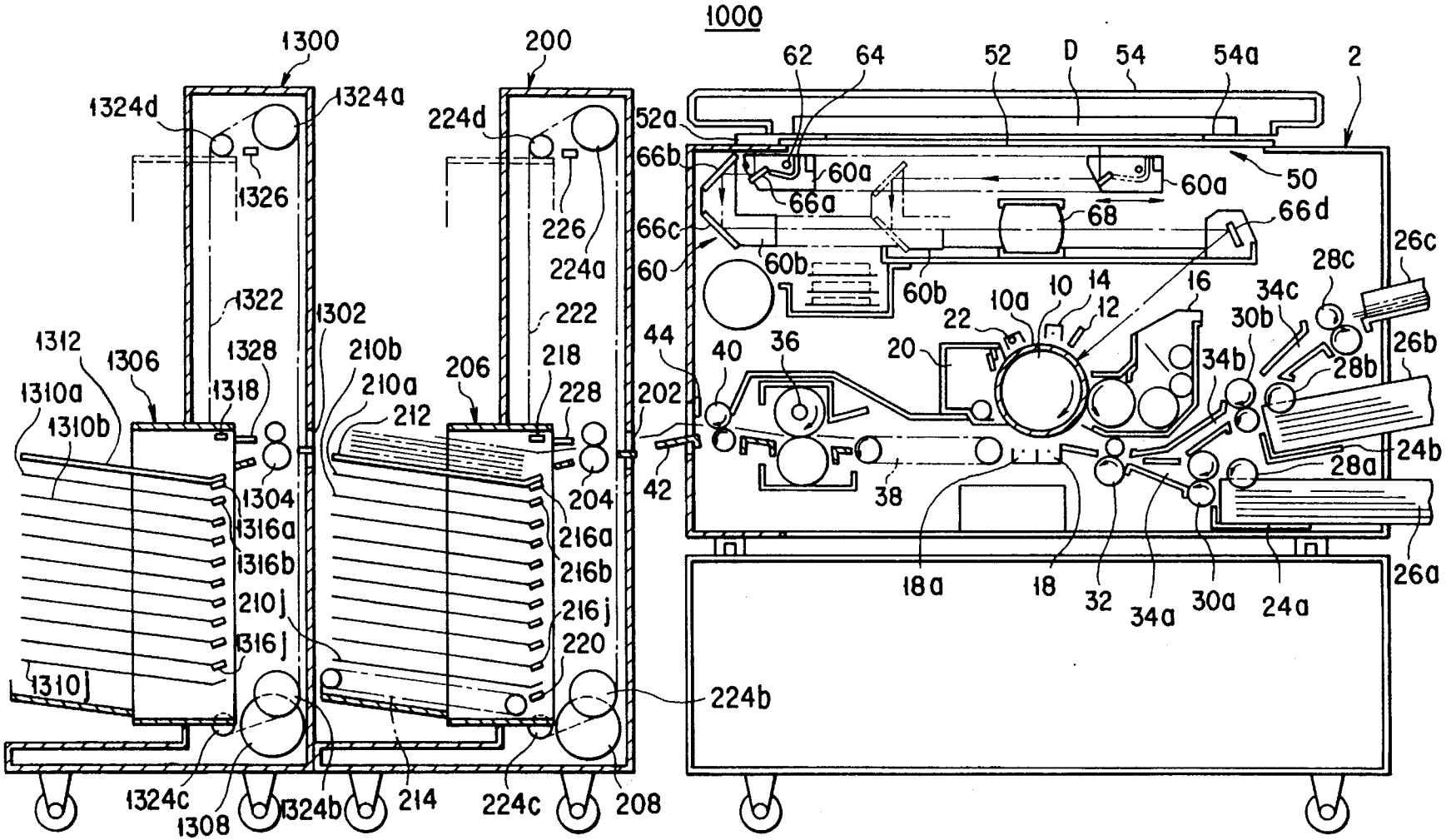
FIG. 9 is a schematic cross section of the copying machine with a sort unit of FIG. 8.

In FIGS. 8 and 9, an image forming device, that is, an electronic copying machine with sorters 1000 has an image forming section for copying an image of an original onto a sheet paper and discharging it, that is, a main body 2 of the copying machine, first and second storing devices for sorting and storing the discharged papers discharged from the main body 2 of the copying machine in accordance with a predetermined mode, that is, first and second sorters 200 and 1300.

In the first and second sorters 200 and 1300, sorters having substantially the same structure are provided in series, and the discharged papers discharged from the main body 2 of the copying machine are sequentially contained therein in accordance with a predetermined sorting method. In a case that the number of the discharged papers is larger than the sorting capacity of the first sorter 200, the number of discharged papers exceeding the sorting capacity of the first sorter 200 is transported to the second sorter 1300 in order.

The structure of the first sorter 200 and that of the second sorter 1300 will be explained as follows:

Since the first and second sorter 200 and 1300 have substantially the same structure, the first sorter 200 will be representively explained.

The first sorter 200 includes an intake 202, a pair of conveying rollers 204 for conveying the discharged papers transferred by the intake 202, and a bin unit 206 for containing the discharged papers conveyed by the covey rollers 204. The bin unit 206 is moved up and down by a lift motor 208 relative to the conveying rollers 204.

The bin unit 206 has a plurality of paper trays, that is, bins 210*a*, 210*b* . . . 210*j*, (ten trays in this embodiment). The bin unit 206 has a discharge tray 212 containing all discharged papers at the time of non-sort storing, that is, non-sort mode is positioned at the upper portion of the bin 210*a* of the uppermost section. At the lower portion of the bin 210*j* of the lowermost section, there is provided a paper transporting device 214 for transporting the discharged paper to the second sorter 1300 when the number of copies cannot be contained in the bin unit 206 of the first sorter 200, that is, the number of copying papers exceeds 11. Each of bins 210*a*, 210*b*, . . . 210*j* is formed such that 50 discharged papers can be contained therein. Also, the discharge tray 212 is formed such that 250 discharged papers can be contained therein.

At the position opposite to each of bins 210*a*, 210*b*, . . . 210*j*, there are provided paper sensors 216*a*, 216*b*, . . . 216*j*, respectively. The paper sensors 216*a* . . .. 216*j* may be arranged at individual bins, respectively, depending on the structure of the device. Also, JAM sensors 218 and 220 are provided at the discharge tray 212 and the paper transferring device 214, respectively.

A driving belt 222 is provided between the lift motor 208 and the bin unit 206 so as to transmit rotational power of the motor 208 to the bin unit 206, and to relatively move the bin unit 206 to the conveying rollers 204. The driving belt 222 is maintained to be rotatable clockwise or anticlockwise by pulleys 224*a* to 224*d*.

At a portion, which is close to the pulley 224*d* and is the highest position where the bin unit 206 can be moved up, there is provided a position sensor 226 for detecting that the bin unit 206 is moved up to the highest position. The position sensor 226, which optically detects the arrival of the bin unit 206, may be used. Or, there may be used the position sensor in which an actuator is pressed up by the bin unit 206 thereby detecting the arrival.

A transfer sensor 228 is provided between the conveying rollers 204 and the bin unit 206 so as to detect that the discharged paper sent from the discharge roller 40 of the main body 2 is contained neither any of bins 210*a* . . . 210*j* nor discharge tray 212, that is, paper jam.

As explained above, since the structure of the second sorter 1300 is substantially the same as the first sorter, the specific explanation will be omitted. This embodiment shows the example in which continuous third sorter, fourth sorter . . . are not arranged. Therefore, in the second sorter 1300, a paper transferring device 1314 and a JAM sensor 1320 are omitted.

In the case that three or more sorters are used, it is needless to say that completely the same device are used in the second sorter 1300 and the first sorter 200 and the sorter, which is provided at the outermost position, corresponds to the sorter 200.

Figure 10:
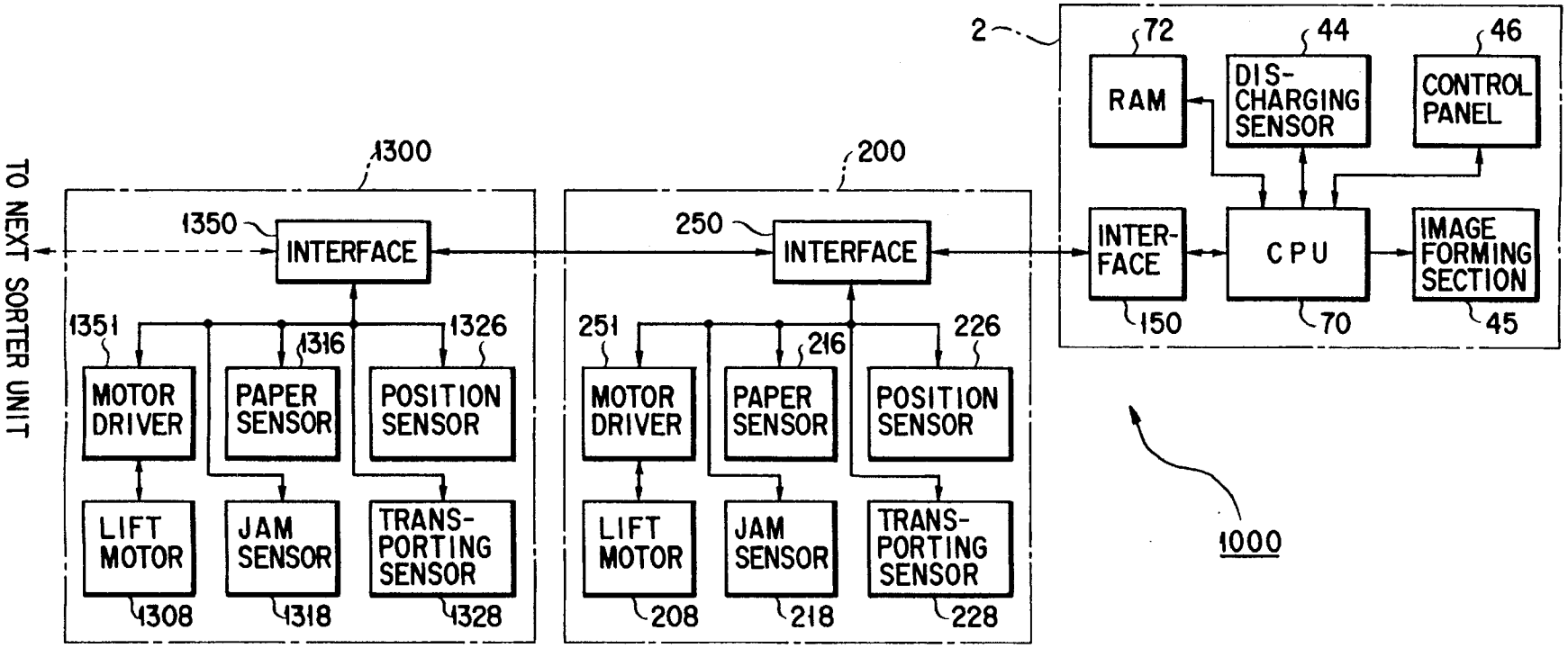
FIG. 10 is a schematic block diagram of the copying machine with a sort unit of FIG. 8.

FIG. 10 is a block diagram showing an electrical connecting state of the embodiment of the present invention.

In the main body 2 of the copying machine, a CPU 70, serving as a main controller for controlling the main body 2, is provided. The respective devices or an electrical circuit group included in the main device 2, e.g., image forming means 45, which includes the devices used to copy the image of the original such as the charging unit 14, developing device 16, and transferring unit 18 as one unit, a discharge sensor 44 for detecting that paper is discharged from the main body 2, a control panel 46 (not shown in FIGS. 8 to 9) for various settings and displays are connected to the CPU 70. Moreover, the first and second sorters 200 and 1300 are connected to the CPU 70 through an interface 150, and controlled by the CPU 70.

The first sorter 200 is connected to the interface 150 of the main body 2 through an interface 250. The interface 250 is connected to the paper sensors 216*a*, 216*b*, . . . 216*j* of the first sorter 200, the JAM sensors 218 and 220, the position sensor 226, the transfer sensor 228, and the motor driver 251. Whereby, the first sorter 200 is driven by the control of the CPU 70 of the main body 2.

Similar to the first sorter 200, paper sensors 1316*a*, 1316*b* . . .. 1316*j* of the second sorter 1300, a JAM sensors 1318, a position sensor 1326, a transfer sensor 1328, and a motor driver 1351 are connected to an interface 1350. Moreover, a lift motor 1308 is connected to the motor driver 1351.

The interface 1350 is connected to the CPU 70 of the main body 2 through the interface 250 of the first sorter 200, and the interface 150 of the main body 2. Whereby, the second sorter 1300 is also controlled by the CPU 70 of the main body.

The above embodiment explained the case that two sorters are connected. However, three or more sorters may be connected. In this case, it is needless to say that the communication interface of the third sorter and the communication interface of the 1350 of the second sorter 1300 are connected to each other. In the explanation of the structure of the above embodiment, the interface of each sorter is connected to the communication interface 150. However, the present invention is not limited to this embodiment. The communication interface of each sorter may be structured to be directly connected to the interface 150 of the main body 2.

The features of the operation of the copying machine 100 with sorter will be explained as follows:

The paper to which the toner image is transferred is conveyed to the fixing unit 36 by the conveying belt 38, the toner image is thermally fixed by the fixing unit 36, and discharged to the first sorter 200 by the discharging roller 40.

The above series of the operations is sequentially repeated a predetermined number of times in accordance with the number of copying papers inputted by the control panel.

The discharged papers discharged from the the main body 2 through the discharge roller 40 are contained in the first sorter 200, bins 210*a* . . . 210*j* of the first sorter 200 and bins 1310*a* . . . 1310*j* of the second sorter 1300, or the discharge tray 212 in accordance with the sort mode inputted by the control panel.

Figure 11:
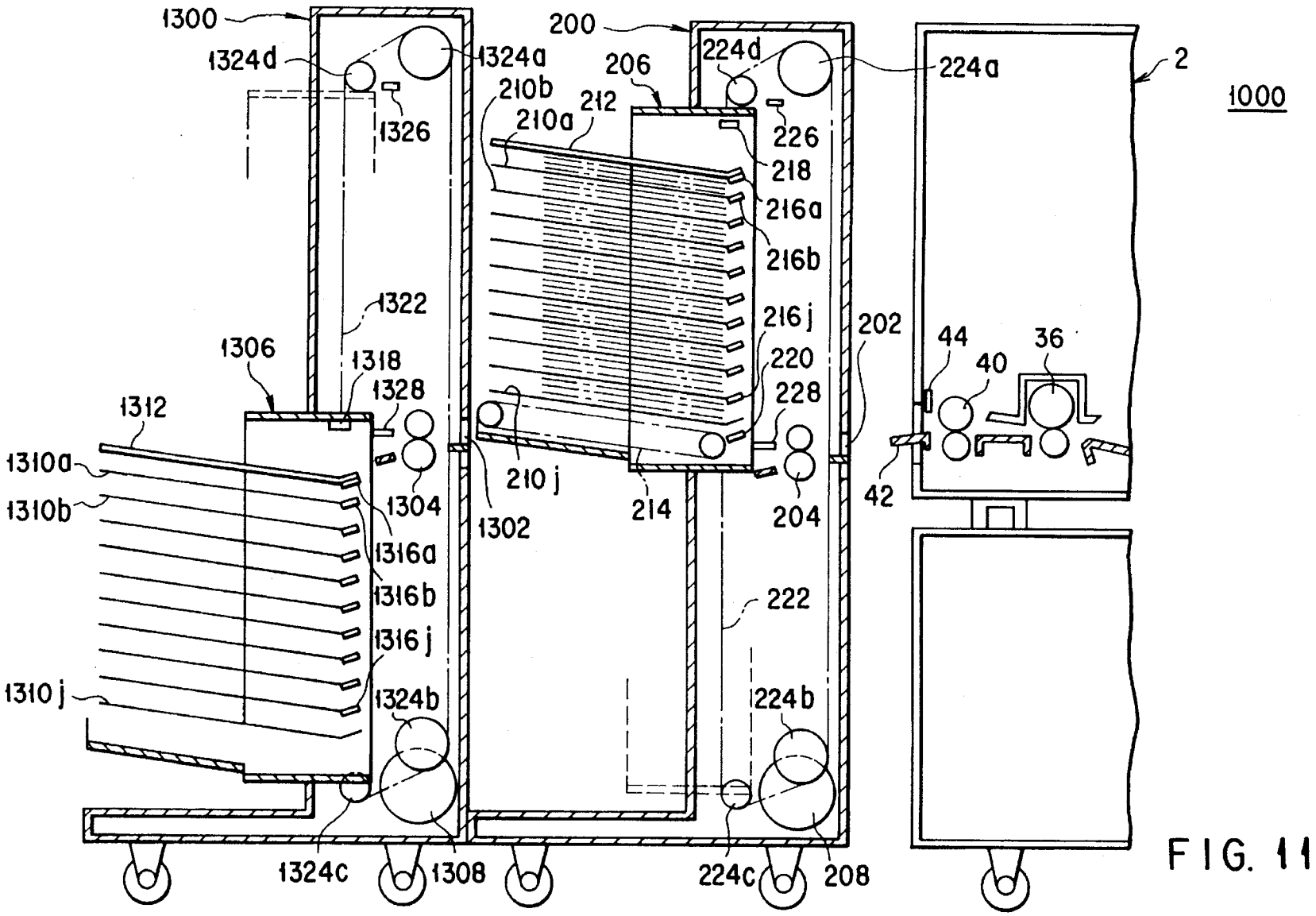
FIG. 11 is a schematic view showing example of an operation of the sorters shown in FIGS. 8 to 10.

FIG. 11 shows an example of the operation of the sorter shown in FIGS. 8 to 10.

According to FIG. 11, the number of originals is three, and the number of sets of copying papers is ten. At the time when the copying is ended, the bin unit 206 is moved to the highest possible position due to the normal operation of the sorter 200, that is, the position where the motor 208 is stopped by detecting a part of the bin unit 206 by use of the position sensor 226.

According to the above method, at the time when a series of copying operations and sorting operations are ended, it is not needed that data of the number of copying papers, which is inputted in starting to copy, is maintained. Due to this, the number of copying papers to be used in a next copying can be inputted.

Figure 12:
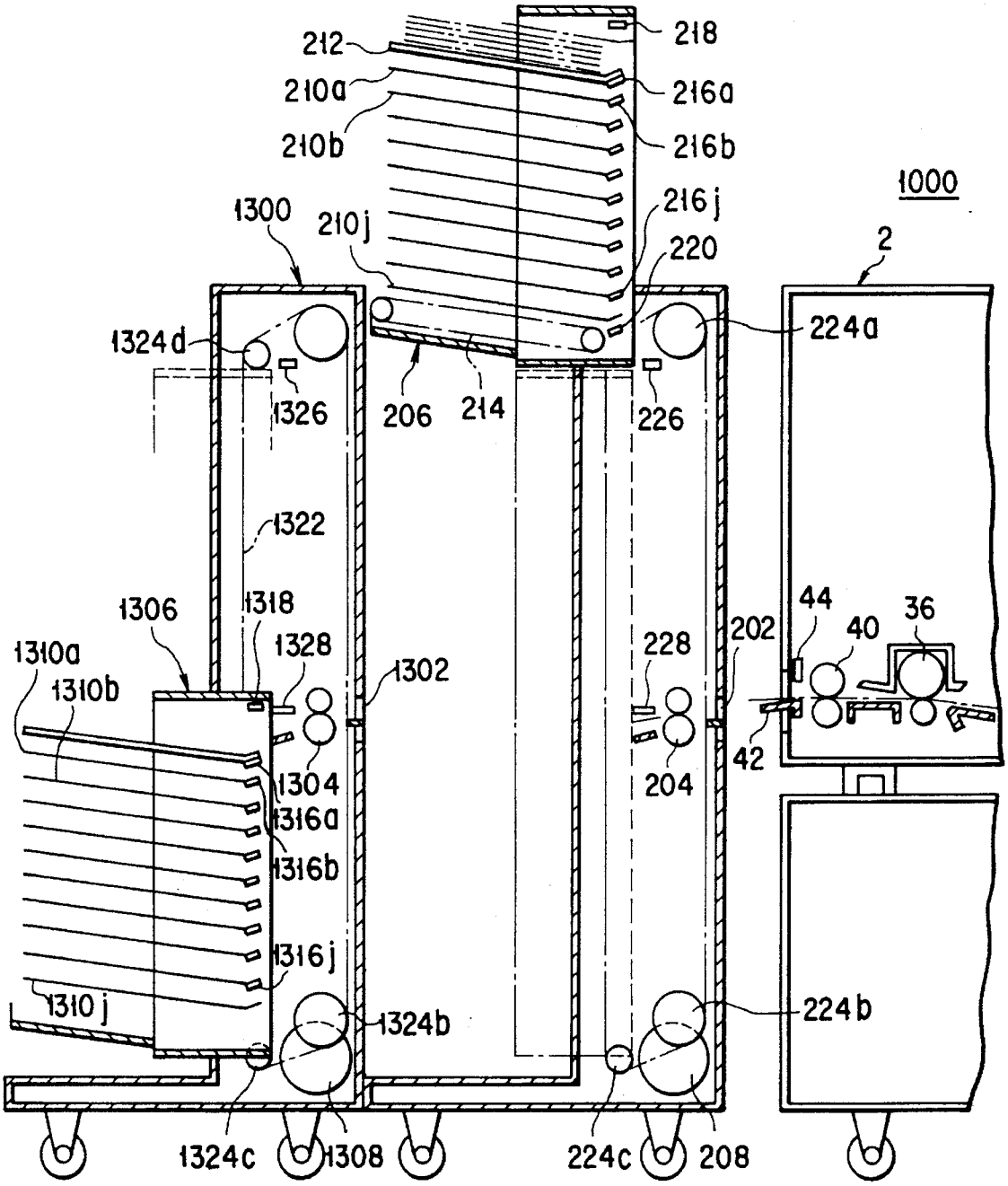
FIG. 12 is a schematic view showing further another example of an operation state sequentially after the operating state shown in FIG. 11.

In the example of FIG. 11, the highest possible position of the bin unit 206 is the portion where the part of the bin unit 206 is detected by the portion sensor 226. However, the present invention is not limited to this example. For example, as shown in FIG. 12, a position where the lowest portion of the bin unit 206 is detected by the position sensor 226 may be set as the highest position. Then, after the end of the copying, the bin unit 206 may be moved up to the highest position.

Figure 13:
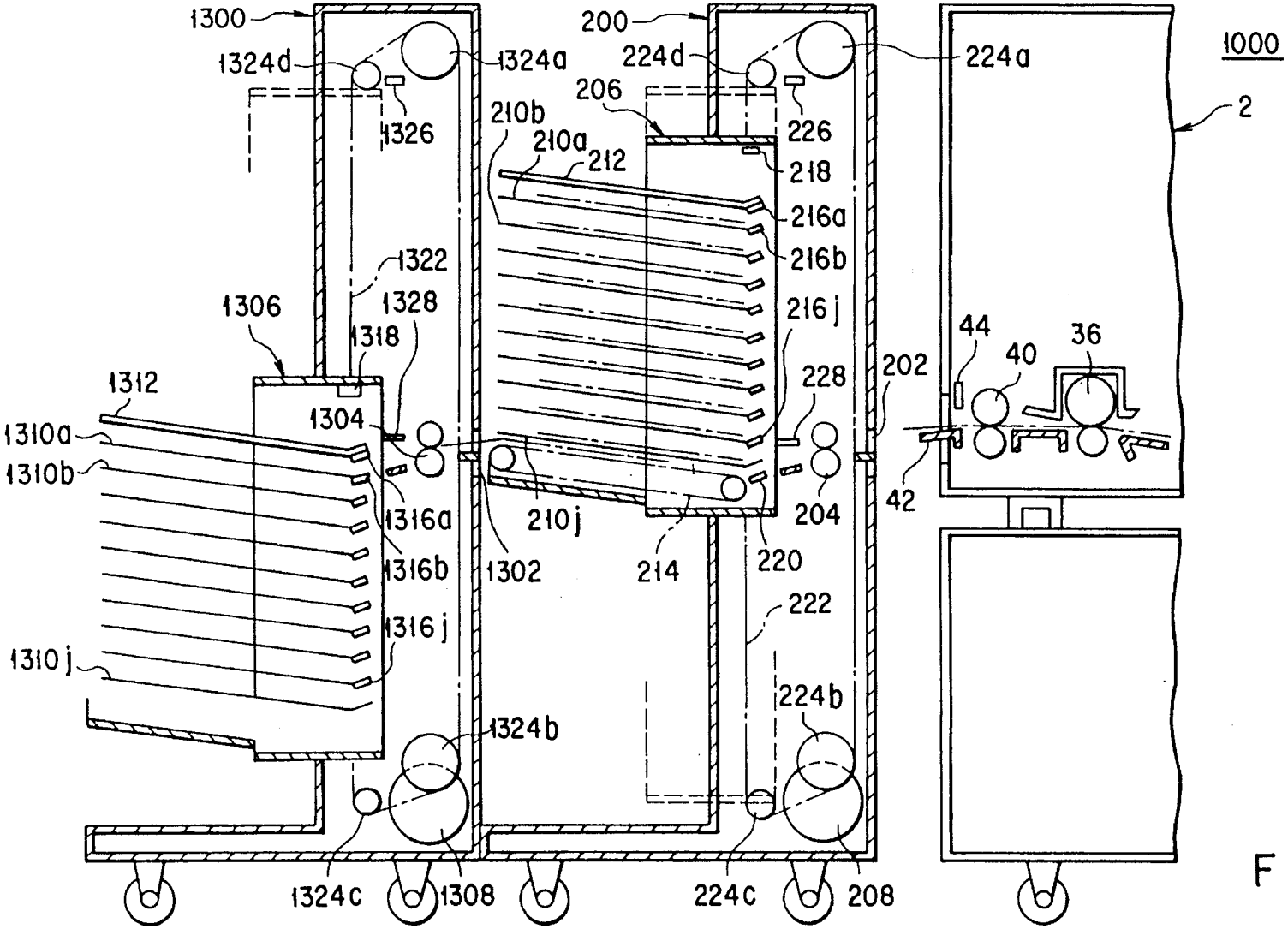
FIG. 13 is a schematic view showing another example of an operating state of the copying machine with a sorter unit of FIGS. 8 to FIG. 14 is a schematic view showing one example of an operation state sequentially after the operating state shown in FIG.
Figure 14:
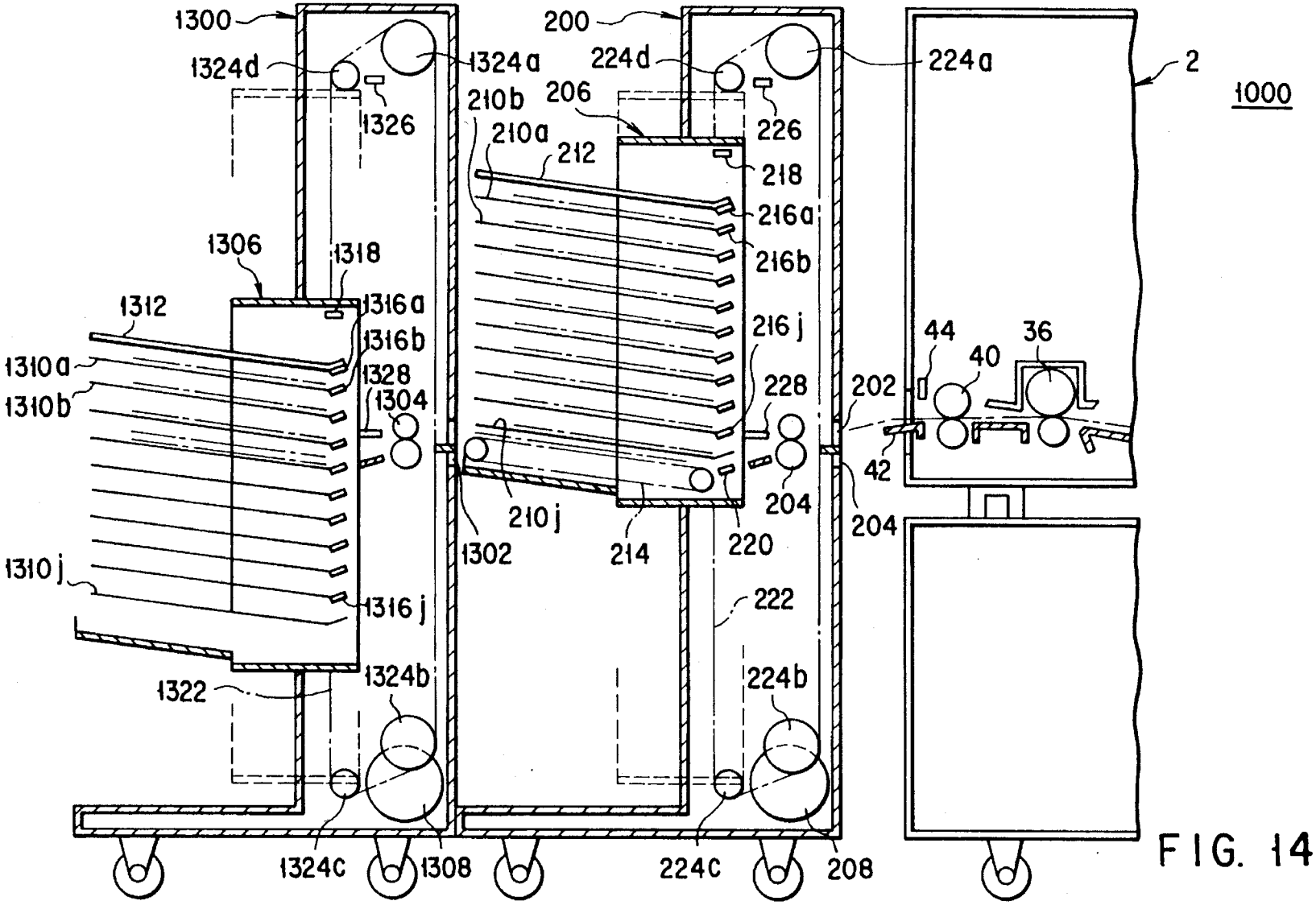
Figure 15:
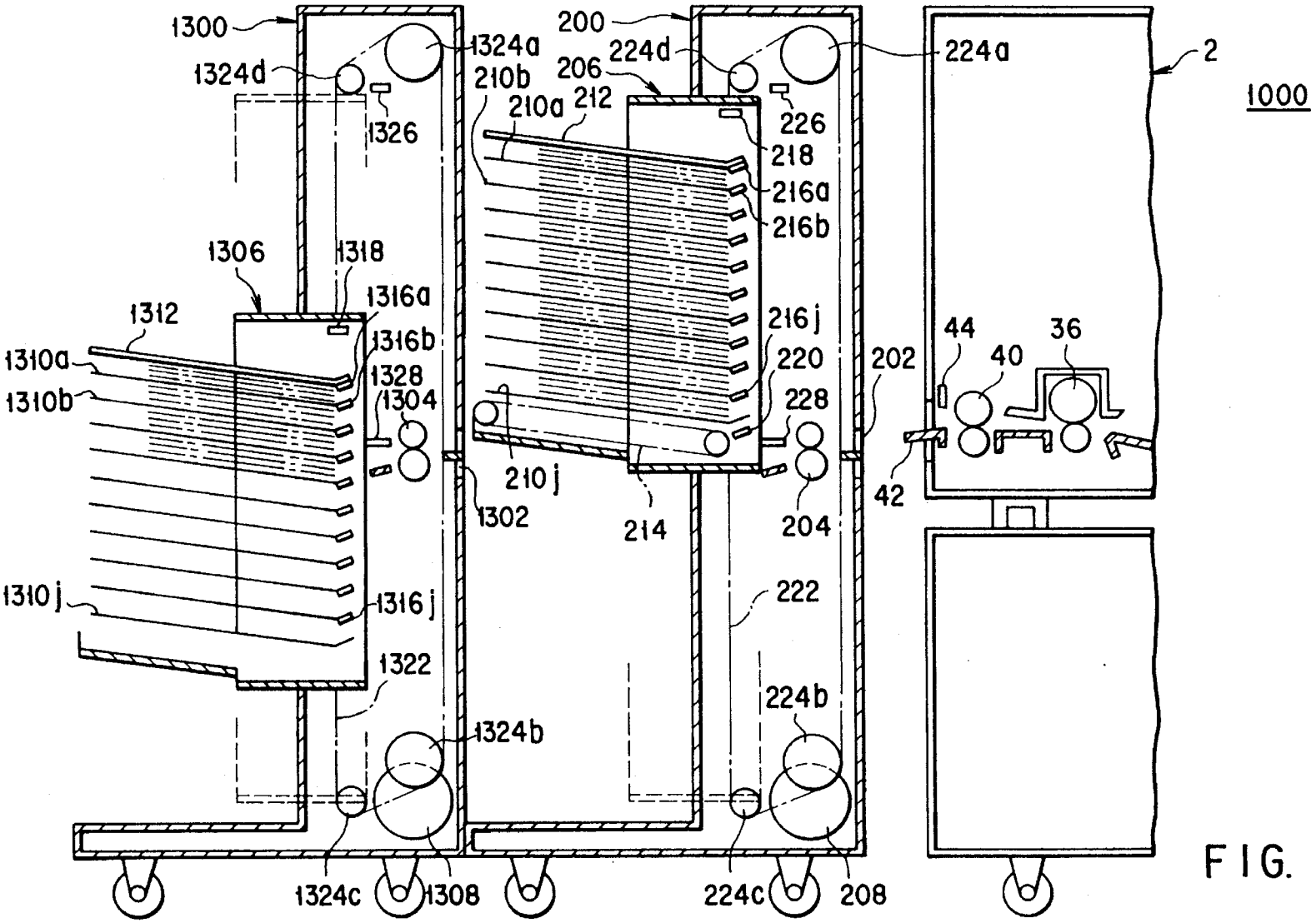
FIG. 15 is a schematic view showing one example of an operation state sequentially after the operating state shown in FIG. 14.

FIGS. 13 to 15 show an example in which the number of originals is three and the number of sets of copying papers is ten or more, for example, 14, and the discharged papers are contained in both first and second sorters 200 and 1300.

The discharged papers of the first original (not shown) are sent to the intake 202 of the first sorter 200 by the discharge roller 40 of the main body, and introduced to the sorter 200. The first discharged paper introduced to the sorter 200 through the intake 202 is driven through the conveying rollers 204, and contained in the bin 210*a* of the bin unit 206. At this time, it is detected by the conveying sensor 228 and the paper sensor 216*a* that the first discharged paper is contained in the bin 210*a*.

Sequentially, the bin unit 206 is driven by the lift motor 208, and moved up by one bin in the direction of the pulley 224*d*. In other words, the bin 210*b* is placed at the position where the paper is conveyed by the conveying rollers 204.

Similarly, the discharged paper, which is fed in a predetermined order, is conveyed to the bin placed at the position to which the paper corresponds. Then, the bin unit 206 is lifted by one bin, and the second discharged paper and the following are supplied to the bin 210*b* . . . bin 210*j* in order.

At the time when the tenth discharged paper is 10 contained in the bin 210*j* (that is, time when it is detected by the discharge sensor 44, conveying sensor 228, and paper sensor 216*j* that the discharged paper is contained in the bin 210*j*), the paper transferring device 214, which is placed at the lowest portion of the bin unit 206, is placed at the position where the paper is conveyed by the conveying rollers 204. Therefore, the continuously discharged paper (11th paper) of the first original is sent to an intake 1302 of the second sorter 1300 through the paper transferring device 214.

At the same time, the conveying roller 1304 of the second sorter 1300 is rotated and the lift motor 1308 is driven, so that the bin 1310*a* of the bin unit 1306 is placed at the position where the paper is conveyed by the conveying roller 1304. Therefore, the 11th paper is conveyed to the bin 1310*a* and contained therein. At this time, it is detected by the conveying sensor 1328 and the paper sensor 1316*a* that the 11th paper is contained in the bin 1310*a*.

Sequentially, the bin unit 1306 of the second sorter 1300 is lifted by one bin in the direction of the pulley 1324 by the lift motor 1308. In other words, the bin 1310*b* is placed at the position where the paper is conveyed by the conveying roller 1304. Then, bin unit 1306 is sequentially lifted by one bin, and the twelfth to fourteenth discharged papers are supplied to the bin 1310*b*, 1310*c*, and 1310*d*, respectively, in order.

At the time when the fourteenth discharged paper is contained in the bin 1310*d*, the image of the second original (not shown) is copied. At this time, the lift motor 1308 is stopped. Then, the bin 1310*d* and the conveying roller 1304 are maintained to be opposite to each other until the first discharged paper of the second image is contained in the bin 1310*d*.

At the time when the first discharged paper of the second original is passed through the paper sensor 1316*d* (shown in FIG. 14), the lift motor 1308 is driven, the bin unit 1306 is moved down by one bin in the direction of the pulley 1324*c*. Similarly, the discharged paper supplied in a predetermined order is sequentially contained in the bin placed at the position to which paper corresponds, and the bin unit 1306 is moved down by one bin, the second to fourth discharged paper are supplied to the bin 1310*c*, 1310*b*, and 1310*a*, in order.

At the time when the fourth discharged paper of the second original is passed through the conveying sensor 1328 of the second sorter 1300, the paper transferring unit 214 of the first sorter 200 is stopped. At the same time, the bin unit 206 of the first sorter 200 is moved down by one bin. Therefore, the fifth discharged paper is contained in the bin 210*j* of the lowest portion of the first sorter.

Similarly, the discharged paper supplied in a predetermined order is sequentially contained in the bin placed at the position to which paper corresponds, and the bin unit 206 is moved down by one bin, the sixth discharged paper and the following discharged papers are supplied to the bin 210*i* . . . 210*b*, 210*a* in order.

FIG. 15 shows the following state:

As a result of the above series of the operations are repeated, the discharged papers are contained in each of the bins 210*a* to 210*j* of the first sorter 200 and each of the bins 1310*a* to 1310*d* of the second sorter by four. Thereafter, the bin unit 206 of the first sorter 200 is moved up again.

In other words, in the case that the number of originals is four (even number), the bin unit 1306 of the second sorter 1300 is stopped in a state that the position of the conveying roller 1304 is matched with the bin 1310*a*. Also, the bin unit 206 of the first sorter 200 is stopped in a state that the position of the conveying rollers 204 is matched with the bin 210*a*. Thereafter, similar to the example of FIGS. 5 to 7, it is recognized that a predetermined time is passed after paper is finally passed through the discharge sensor 44, whereby the end of copying is confirmed. Moreover, a predetermined period of time is passed, whereby, a next copying operation is prohibited, the lift motor 208 is driven, and the bin unit 206 of the first sorter 200 is moved in the direction of the pulley 224*d* until, for 10 example, the position sensor 226 is actuated.

As is obvious from FIG. 15, the bin unit 1306 of the second sorter 1300 is stopped at a state that the final paper is contained, that is, arbitrary position, or the bin unit 1306 may be moved to a predetermined position, e.g., the home position (not shown).

As mentioned above, at the time when all discharged papers are contained in the first and second sorters 200 and 300, the bin unit 206 of the first sorter 200, which is sandwiched between the main body 2 and the second sorter 300, is moved up by a predetermined quantity, thereby making it possible to easily take up the discharged papers contained in the bin 210*h*, 210*i* or 210*j*.

Figure 16:
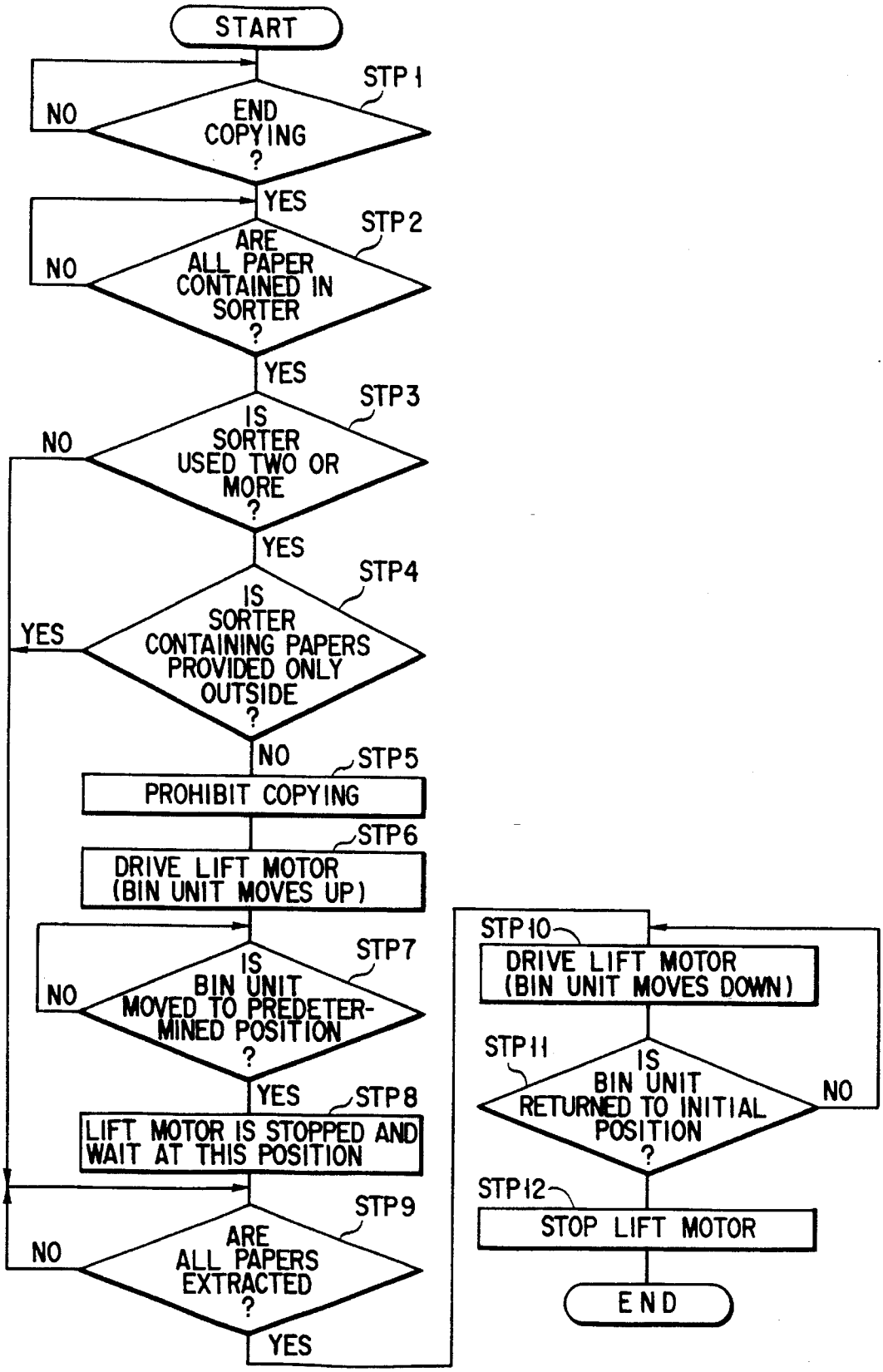
FIG. 16 is a flow chart showing the outline of the sorter shown in each embodiment.

FIG. 16 shows an operation of each of the sorters 200 and 300 shown in FIGS. 2 to 7 and an operation of each of the sorters 200 and 1300 shown in FIGS. 9 to 15.

In step STP 1, it is confirmed by CPU 70 whether or not all image forming operations due to image forming means 45 are ended. Sequentially, the outputs from JAM sensors 218, 220, and 318 (1318), the transferring sensors 228 and (1328), paper sensors 216*a* to 216*j*, and 316*a* (1316*a*) to 316*j* (1316*j*) are checked. Then, it is confirmed whether or not all discharged papers are contained in each of the bin unit 206 of the sorter 200 and the main body 302 (or bin unit 1306) of the sorter 300 (1300) in step STP 2.

Sequentially, the number of sorters which contains the discharged papers is/are checked by the CPU 70 (STP 3).

If it is confirmed that all discharged papers are contained in the predetermined position of each of the bins 210*a* to 210*j* of the sorter 200 and that of each of the bins 310*a* (1310*a*) to 310*j* (1310*j*) of the sorter 300 (1300) in step STP 3, the sorter, which is positioned between the main body 2 and the most outer sorter 300 (1300), that is in this application, the first sorter 200 is selected in step STP 4.

Then, a copy prohibition signal is outputted from the CPU 70, thereby defining an input prohibition state in which a designation of starting a new copy from the control panel is rejected in step STP 5. A signal for driving the lift motor 208 is outputted to the motor driver 251 in connection with the first sorter 200 selected in step STP 4, so that the bin unit 206 is moved up to a predetermined position, that is, a second position, which is defined to be upper than the first position (home position (not shown) that is, initial position) in step STP 6. Then, the output is read out form the position sensor 226 or the number of driving pulses to be supplied to the lift motor is counted, whereby it is detected whether or not the bin unit 206 is moved to a predetermined position (second position) in step STP 7.

If the bin unit 206 is moved up to the predetermined position, the CPU 70 designates to the motor driver 251 of the first sorter 200 to stop the lift motor 208, and the lift motor 208 is stopped at a predetermined position in step STP 8.

A predetermined position where the bin unit 206 is stopped is defined to be either the position where the bin corresponding to the number of copying papers is opposite to the conveying rollers 204 or the highest position where the bin unit 206 can be moved.

In a state that the bin unit 206 is moved up to the predetermined position, the output of each of the paper sensors 216*a* to 210*j* is read out, whereby it is detected whether or not all papers are extracted from the respective bins 210*a* to 210*j* in step STP 9.

If it is detected that all papers are extracted from the respective bins 210*a* to 210*j* in step STP 9, the CPU 70 outputs the signal for driving the lift motor 208 to the motor driver 251, so that the bin unit 206 is moved down in step STP 10.

If it is detected that the bin unit 206 is moved up to the initial position (that is, the first position or the home position where the bin unit 206 is positioned when the sorter is in the non-operation state) by the home position sensor (not shown) in step STP 11, the CPU 70 designates to the motor driver 251 of the first sorter 200 to stop the lift motor 208, and the lift motor 208 is stopped in step STP 12.

As mentioned above, according to the copying machine with sorter, at the time when all discharged papers discharged from the main body of the copying machine are contained after the end of copying, the bin unit of the sorter provided close to the main body, and between the main body and the sorter, which is provided at the position away from the main body, is moved up to a predetermined position.

Therefore, a user can extract the discharged paper from the bin, which is placed at the relatively high position (where one can take up the discharged papers with a comfortable posture), regardless of the location where the sorter is provided or the number of bins used. As a result, the papers, which are contained in the sorter provided to be sandwiched between other sorters, can be easily extracted. Also, no useless operation is generated in the sorter of the outermost portion where the paper can be easily extracted since the control of the rise of the bin unit is excluded in advance.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An image forming apparatus with a plurality of sorters, comprising:

a main body of said image forming apparatus for forming an image on paper, and discharging the paper on which the image is formed;

a first sorter, connected to said main body of the image forming apparatus, for containing the image formed paper discharged from said main body of the image forming apparatus, said first sorter having a plurality of bins for containing said paper and storing means with a first height having said plurality bins attached; and a second sorter, connected between said first sorter and said main body of the image forming apparatus, for containing the image formed paper discharged from said main body of the image forming apparatus, said second sorter having storing means with a plurality of bins for containing said paper and a motor for moving said storing means to a position at least higher than said first height when the image formed paper discharged from said main body of the image forming apparatus is contained in the plurality of bins of said storing means.

2. The image forming apparatus according to claim 1, wherein said first sorter contains the paper passed through said second sorter.

3. The image forming apparatus according to claim 1, wherein said second sorter comprises limiting means for limiting a range of said storing means relatively movable to a position where the paper is discharged from said main body of the image forming apparatus, and a motor for relatively moving said storing means to the position where the paper is discharged from said main body of the image forming apparatus, and said storing means comprises detecting means for detecting that all papers are contained in said storing means itself from said image forming means.

4. An image forming apparatus with a plurality of sorters, comprising:

a main body of said image forming apparatus for forming an image on paper, and discharging the paper on which the image is formed;

a first sorter with a predetermined height, provided at the farthest away from said main body of the image forming apparatus, among a plurality of sorters, connected to said main body of the image forming apparatus, for containing the image formed paper discharged from said main body of the image forming apparatus;

a second sorter, connected between said first sorter and said main body of the image forming apparatus, for containing the image formed paper discharged from said main body of the image forming apparatus, said second sorter having storing means with a plurality of bins arranged in upper and lower directions to contain said paper; and a motor for moving said storing means such that the bin positioned at the lowest of all bins containing the image formed papers is placed at a position higher than said predetermined height when the image formed paper discharged from said main body of the image forming apparatus is contained in said second sorter.

5. The image forming apparatus according to claim 4, wherein said first sorter contains the paper passed through said second sorter.

6. The image forming apparatus according to claim 4, wherein said second sorter comprises limiting means for limiting a range of said storing means relatively movable to a position where the paper is discharged from said main body of the image forming apparatus, and a motor for relatively moving said storing means to the position where the paper is discharged from said main body of the image forming apparatus, and said storing means comprises detecting means for detecting that all papers are contained in said storing means itself from said image forming means.

7. An image forming apparatus with a plurality of sorters, comprising:

image forming means for forming an image on paper;

a main body of said image forming apparatus having a first discharge port for discharging paper on which the image is formed by said image forming means;

a first sorter, connected to said main body of the image forming apparatus, having a first height, for containing the image formed paper discharged from said first discharge port; said first sorter having storing means with a plurality of bins for containing said image formed paper, a motor for moving said storing means, and a second discharge port for discharging the image formed paper discharged from said first discharge port to a lower stream;

a second sorter, provided to be connectable to said first sorter, having a second height, for containing image formed paper discharged from said second discharge port of said first sorter when being connected to said first sorter; and control means for controlling said first sorter such that said storing means is moved until the bin provided at the lowest position of all bins containing the image formed papers of said storing means of said first sorter reaches a position at least higher than the height of said second sorter when all image formed papers are contained in said first sorter after the end of the image forming operation by said image forming means of said main body of the image forming apparatus.

8. The image forming apparatus according to claim 7, wherein said second sorter contains the paper passed through said first sorter.

9. The image forming apparatus according to claim 7, wherein said first sorter comprises limiting means for limiting a range of said storing means relatively movable to a position where the paper is discharged from said main body of the image forming apparatus, and a motor for relatively moving said storing means to the position where the paper is discharged 10 from said main body of the image forming apparatus, and said storing means comprises detecting means for detecting that all papers are contained in said storing means itself from said image forming means.

* * * * *